US009004789B2

(12) United States Patent
Sasaki

(10) Patent No.: US 9,004,789 B2
(45) Date of Patent: Apr. 14, 2015

(54) PROCESSING DEVICE

(75) Inventor: Taishi Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/128,098

(22) PCT Filed: Jun. 25, 2012

(86) PCT No.: PCT/JP2012/004088

§ 371 (c)(1),
(2), (4) Date: Dec. 20, 2013

(87) PCT Pub. No.: WO2013/021537

PCT Pub. Date: Feb. 14, 2013

(65) Prior Publication Data

US 2014/0140748 A1 May 22, 2014

(30) Foreign Application Priority Data

Jun. 30, 2011 (JP) ..... 2011-145513

(51) Int. Cl.
*B41J 33/00* (2006.01)
*B41J 33/52* (2006.01)

(52) U.S. Cl.
CPC ..... *B41J 33/52* (2013.01)

(58) Field of Classification Search
USPC ..... 400/231
See application file for complete search history.

(56) References Cited

U.S. PATENT DOCUMENTS 3,967,790 A * 7/1976 Hess ..... 242/415.1
4,299,504 A * 11/1981 Benz et al. ..... 400/208
5,370,470 A 12/1994 Kim
5,622,440 A 4/1997 Yamamoto et al.
5,667,318 A * 9/1997 Tanno et al. ..... 400/208
5,835,118 A * 11/1998 Fisher et al. ..... 347/214
7,736,077 B2 * 6/2010 Yamamoto ..... 400/208
8,333,524 B2 * 12/2012 Bandholz et al. ..... 400/234
2005/0201802 A1 9/2005 Yamamoto
2005/0201803 A1 9/2005 Yamamoto et al.
2005/0201804 A1 9/2005 Yamamoto
2005/0201805 A1 9/2005 Yamamoto
2005/0201806 A1 9/2005 Yamamoto (Continued)

FOREIGN PATENT DOCUMENTS

EP 1577104 9/2005
EP 1769934 4/2007
JP 04-152179 A 5/1992

(Continued)

OTHER PUBLICATIONS

Search Report and Written Opinion received in International Application No. PCT/JP20121004088, Nov. 9, 2012.

*Primary Examiner* — Anthony Nguyen
(74) *Attorney, Agent, or Firm* — ALG Intellectual Property, LLC

(57) ABSTRACT

A processing device comprising a ribbon cartridge including an ink ribbon wound around a feed-out core and a wind-up core winding up the ink ribbon, a device main body to which the ribbon cartridge is detachably attached, a cartridge-side brake mechanism provided to the ribbon cartridge and applying a rotational braking force to the ribbon cartridge, and a device-side brake mechanism provided to the device main body and applying a rotational braking force to the ribbon cartridge, wherein a rotational braking force by the cartridge-side brake mechanism is set stronger with respect to a rotational braking force by the device-side brake mechanism.

5 Claims, 13 Drawing Sheets

(56) References Cited

U.S. PATENT DOCUMENTS

| | | | | |
|---|---|---|---|---|
| 2006/0233581 | A1* | 10/2006 | Sawai | 400/120.16 |
| 2007/0077107 | A1 | 4/2007 | Dochi et al. | |
| 2008/0187385 | A1 | 8/2008 | Yamamoto | |
| 2009/0311025 | A1 | 12/2009 | Bandholz et al. | |
| 2011/0299907 | A1* | 12/2011 | Kim et al. | 400/207 |

FOREIGN PATENT DOCUMENTS

| | | | |
|---|---|---|---|
| JP | 2007-130847 | A | 5/2007 |
| JP | 2009-006666 | A | 1/2009 |

* cited by examiner (a)

(b)

(a)

(b)

(a)

(b)

PROCESSING DEVICE

BACKGROUND

1. Technical Field

The invention relates to a processing device for applying back tension to an ink ribbon, which is fed from an ink cartridge, via a feed core.

2. Related Art

In the past, there has been known a processing device provided with a ribbon cartridge having an ink ribbon wound around a feed core and a winding core for winding the ink ribbon housed in a case, a processing device main body (a printer device) to which the ribbon cartridge is detachably attached, and a device-side brake mechanism provided to the processing device main body, and for applying back tension to the ink ribbon fed therefrom via the feed core (see JP-A-2009-006666).

One end portion of the feed core of the processing device is provided with an engaging section formed to have a corrugated shape. On the other hand, the device-side brake mechanism is provided with an engaging member (an engaging projection) engaging with the engaging section of the feed core when mounting the ribbon cartridge on the processing device main body, and a torque limiter for applying the back tension to the ink ribbon.

In the conventional processing device, in the case in which the corrugation position of the engaging section of the feed core does not coincide with the position of the engaging projection of the device-side brake mechanism, and collides therewith, the feed core on which no braking force is acted is rotated to thereby make the engaging projection enter the recess of the engaging section, and couple therewith.

However, in the case in which the feed core rotates in the feeding direction, there is a problem that a slack is caused in the ink ribbon fed to the wind-up core side to thereby make the normal feeding operation of the ink ribbon unachievable.

On the other hand, it is unachievable for the device-side brake mechanism to prevent the slack in the ink ribbon when carrying the ribbon cartridge alone. Since the torque limiter of the device-side brake mechanism is required to have the performance of preventing the braking force from varying (deteriorating) with time, there is a tendency of raising the cost.

SUMMARY

An advantage of some aspects of the invention is to provide a processing device which makes it possible to mount the ribbon cartridge on the processing device main body without causing a slack in the ink ribbon at low cost.

An aspect of the invention is directed to a processing device including a ribbon cartridge housing an ink ribbon and a processing device main body to which the ribbon cartridge is detachably attached, and using a cartridge-side brake mechanism provided to the ribbon cartridge and a device-side brake mechanism provided to the processing device main body, applies back tension to the ink ribbon to be wound up by a wind-up core of the ribbon cartridge via a feed-out core, and is characterized in that a braking force of the device-side brake mechanism is set weaker with respect to a braking force of the cartridge-side brake mechanism.

According to this configuration, the rotational braking force is applied to the feed-out core in the ribbon cartridge, which is not mounted on the processing device main body, by the cartridge-side brake mechanism and thus the slack of the ink ribbon can be prevented. Further, when mounting the ribbon cartridge on the processing device main body, the back tension is applied to the ink ribbon, which has been fed out, from the device-side brake mechanism besides the cartridge-side brake mechanism. Further, the braking force of the device-side brake mechanism is set weaker then the braking force of the cartridge-side brake mechanism. Therefore, even if the device-side brake mechanism has contact therewith so as to urge the feed-out core to rotate when mounting the ribbon cartridge on the processing device main body, there is no chance for the feed-out core to rotate due to the braking force of the cartridge-side brake mechanism. Thus, there is no chance that the slack is caused in the ink ribbon mounted on the processing device main body and then fed out toward the wind-up core, and thus the ink ribbon can be transported normally.

Further, since it is assumed that the cartridge-side brake mechanism is disposable together with the ribbon cartridge, durability is not required. On the other hand, it is sufficient for the device-side brake mechanism to exert weak braking force. Therefore, each of the brake mechanisms can be configured at low cost.

In the aspect of the invention, it is preferable that the processing device further includes a brake transmission mechanism making it possible to transmit the braking force of the device-side brake mechanism to the feed-out core when mounting the ribbon cartridge on the processing device main body.

In the aspect of the invention, it is preferable that the brake transmission mechanism includes a cartridge-side pivot fitted to be fixed to the feed-out core, and rotatably supported by a sidewall section of the ribbon cartridge, a cartridge-side gear axially fixed to the cartridge-side pivot, a device-side gear releasably engaged with the cartridge-side gear, and a device-side pivot supported by a frame of the processing device main body, rotatably supporting the device-side gear, and connected to the device-side brake mechanism.

According to these configurations, the braking force of the device-side brake mechanism can be transmitted to the feed-out core via the brake transmission mechanism. Thus, the cartridge-side brake mechanism and the device-side brake mechanism brake the rotation of the ribbon cartridge mounted on the processing device main body, and the stable back tension can be applied to the ink ribbon.

Further, when mounting the ribbon cartridge on the processing device main body, if the cartridge-side gear has contact with the device-side gear, the device-side gear connected to the device-side brake mechanism with weak braking force is rotated. Thus, the rotation of the feed-out core (the cartridge-side gear) is limited due to the action of the braking force of the cartridge-side brake mechanism, and it is possible to prevent the slack from occurring in the ink ribbon.

In the aspect of the invention, it is preferable that the cartridge-side gear also functions as an operation knob adapted to manually rotate the feed-out core.

According to this configuration, even in the case in which the feed-out core is unintentionally rotated to loosen the ink ribbon, it is possible to rewind the ink ribbon thus loosened to the feed-out core using the cartridge-side gear as the operation knob.

In the aspect of the invention, it is preferable that the cartridge-side brake mechanism is connected to one end portion of the feed-out core to apply a rotational braking force to the feed-out core, and the device-side brake mechanism is connected to the other end portion of the feed-out core to apply a rotational braking force to the feed-out core.

According to this configuration, the feed-out core is pivoted in the condition in which the rotational braking forces are applied at both ends in the axial direction by the cartridge-side brake mechanism and the device-side brake mechanism. Thus, since it is possible to apply the equal and stable braking force to the feed-out core, it is possible to apply the uniform back tension to the ink ribbon having been fed out.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a tape printer as an embodiment of the invention will be explained with reference to the accompanying drawings. The tape printer is attached with a tape cartridge housing a printing tape wound in a roll and a ribbon cartridge housing an ink ribbon, and is for performing printing while feeding the printing tape and the ink ribbon so as to run together with each other, and then cutting the printed part of the printing tape to thereby make a label.

Figure 1:
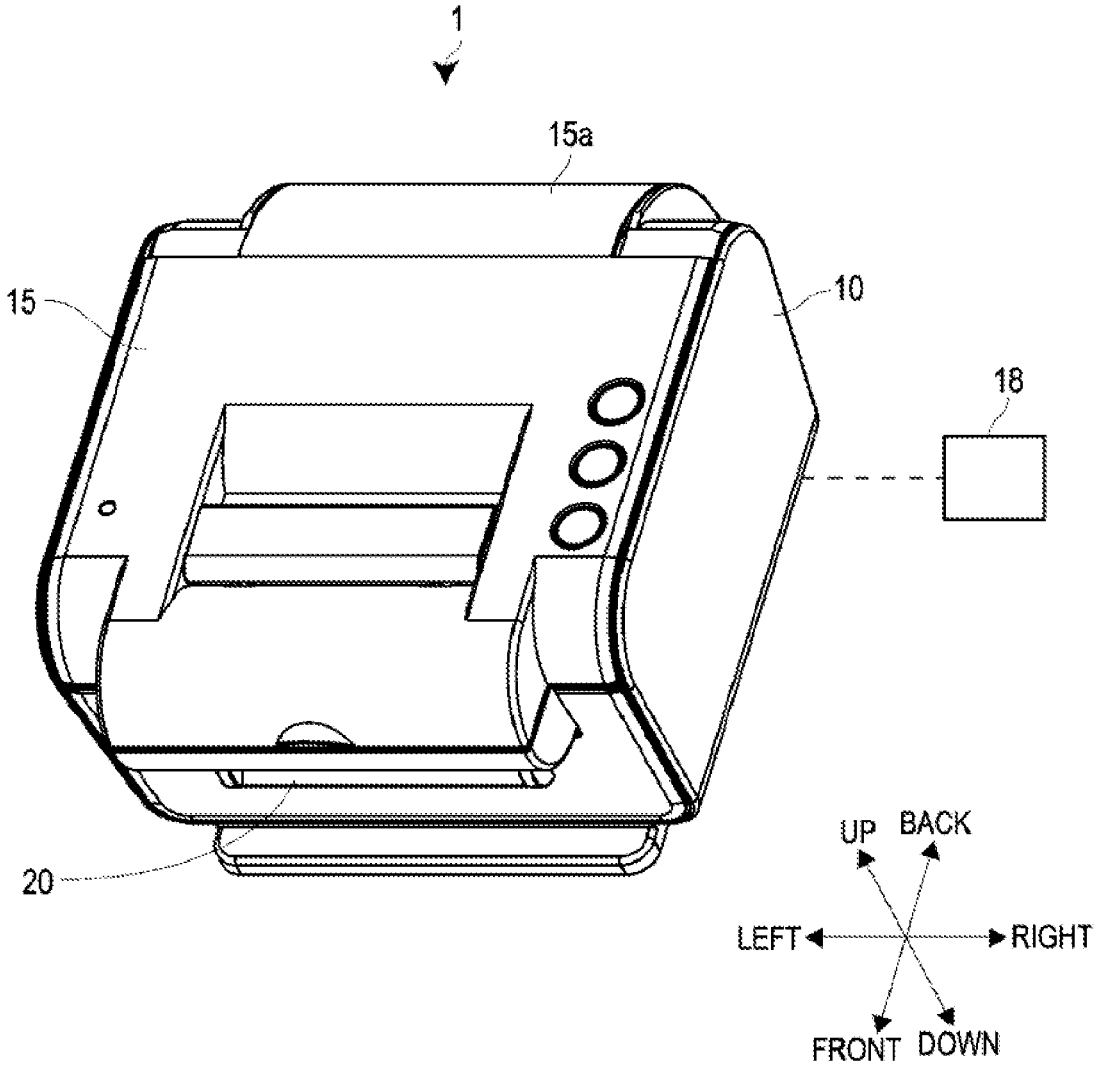
FIG. 1 is an external perspective view of a tape printer according to an embodiment of the invention.
Figure 2:
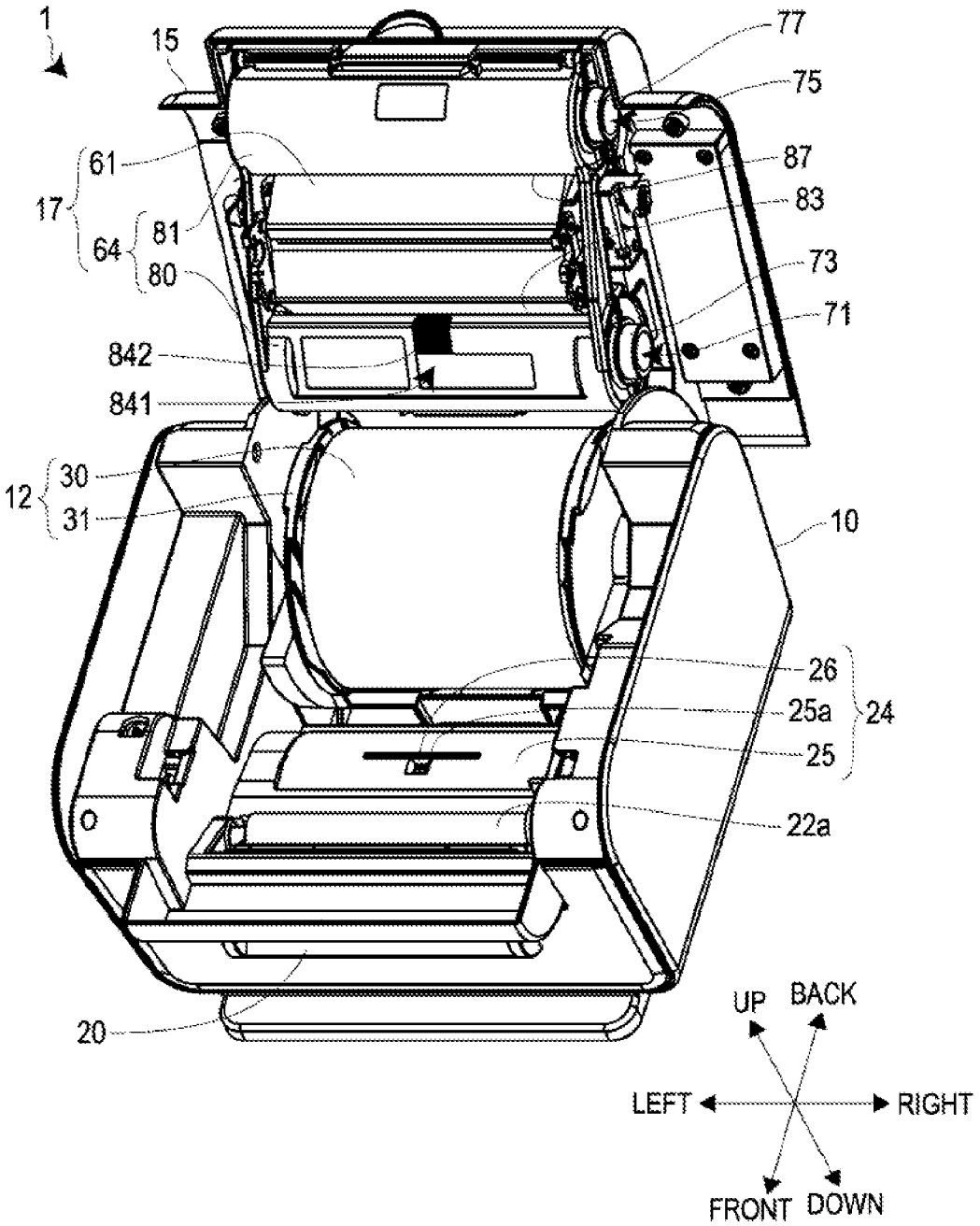
FIG. 2 is an external perspective view of the tape printer in the state in which a lid case is opened, and a tape cartridge and a ribbon cartridge are mounted thereon.
Figure 3:
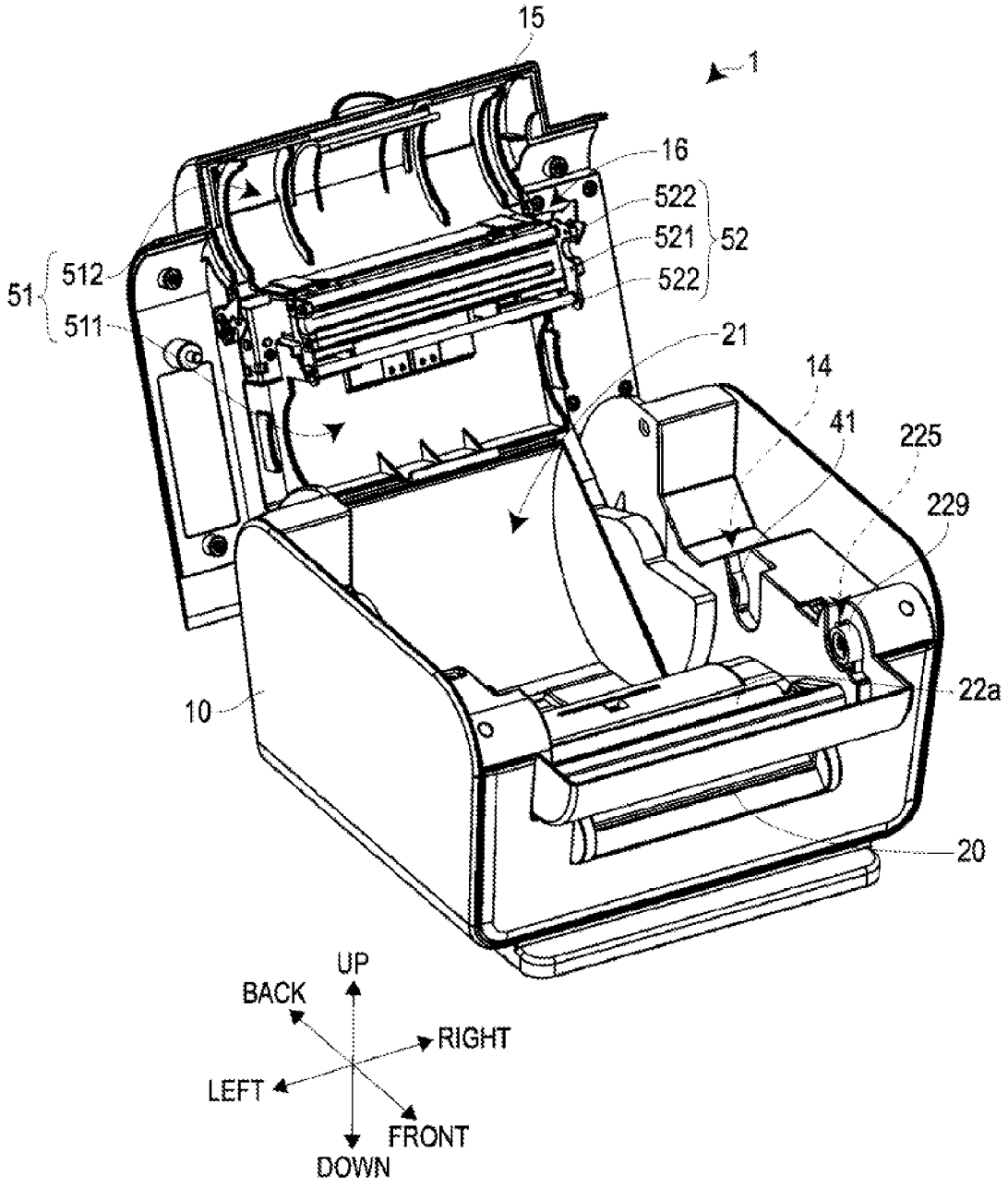
FIG. 3 is an external perspective view of the tape printer in the state in which the lid case is opened, and the tape cartridge and the ribbon cartridge are detached therefrom.
Figure 4:
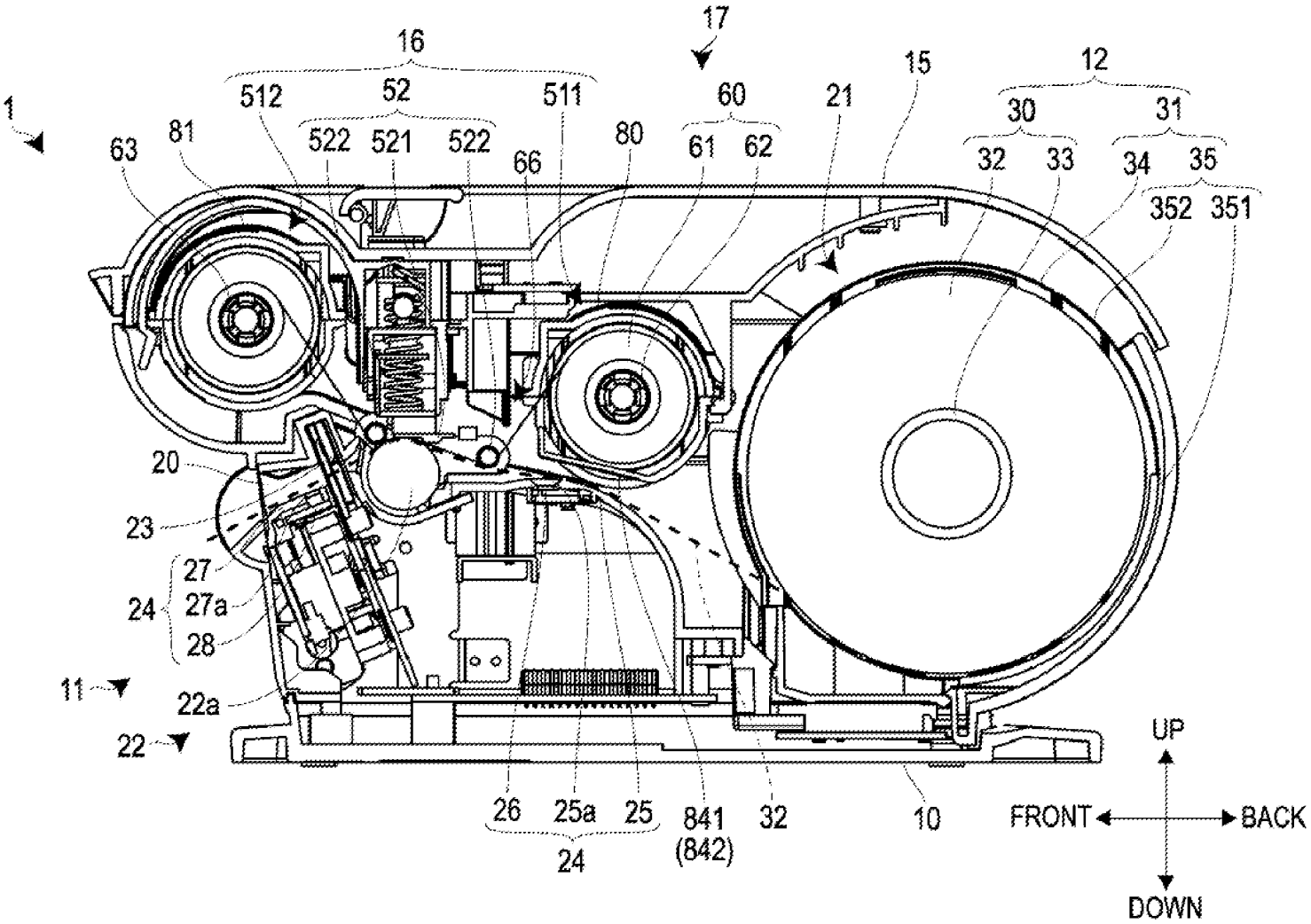
FIG. 4 is a side cross-sectional view of the tape printer according to the present embodiment.
Figure 5:
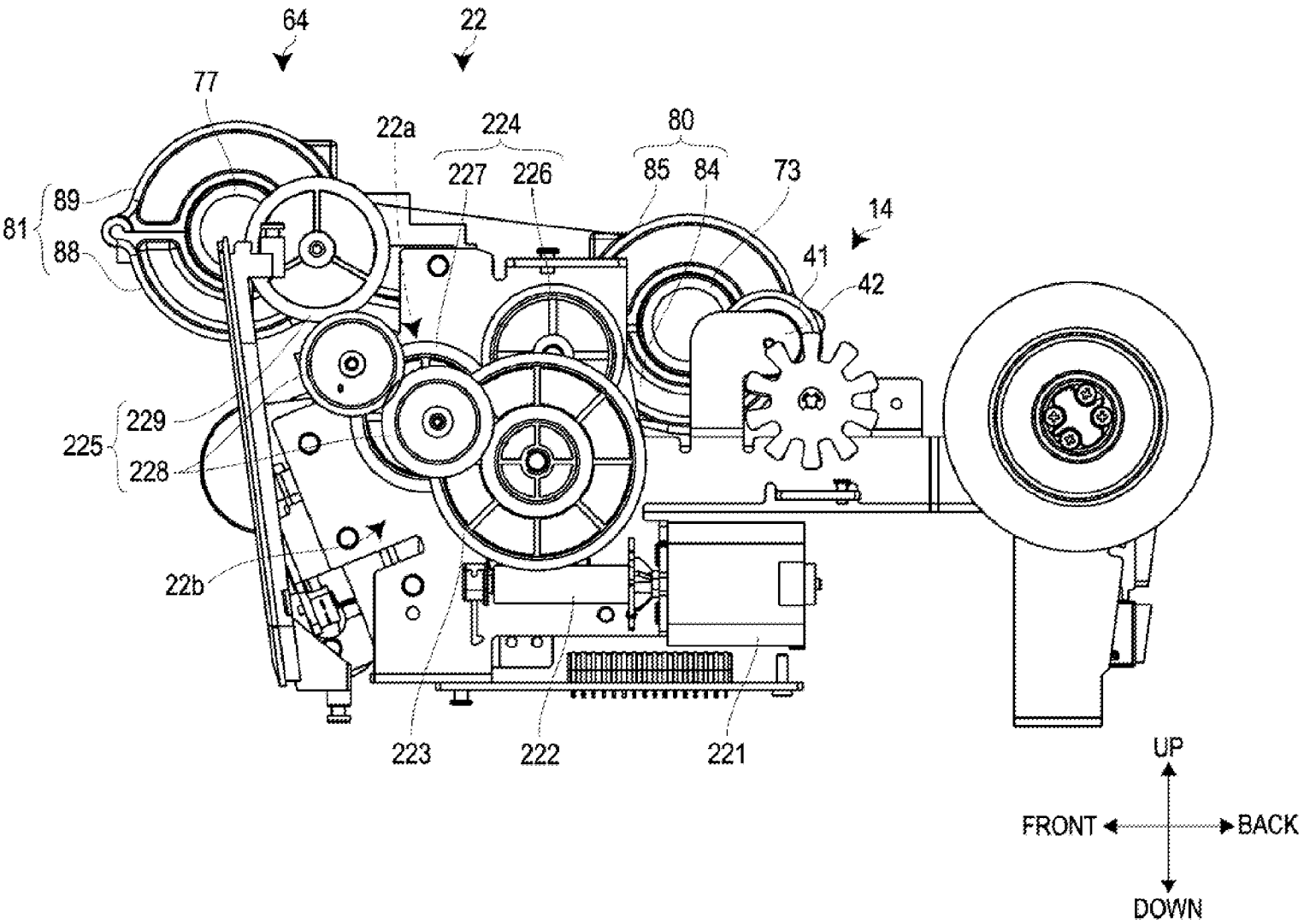
FIG. 5 is a side view of a transport driving device of a tape transport mechanism.

The tape printer 1 will be explained with reference to FIGS. 1 through 5. FIG. 1 is an external perspective view of the tape printer 1. FIG. 2 is an external perspective view of the tape printer 1 in the state in which a lid case 15 is opened, and a tape cartridge 12 and a ribbon cartridge 17 are mounted thereon. FIG. 3 is an external perspective view of the tape printer 1 in the state in which the lid case 15 is opened, and the tape cartridge 12 and the ribbon cartridge 17 are detached therefrom. FIG. 4 is a side cross-sectional view of the tape printer 1. FIG. 5 is a side view of a transport driving device 22*b* of a tape transport mechanism 22. It should be noted that in the following explanation, up, down, front, back, right, and left are defined as indicated by the arrows in each of the drawings.

As shown in FIGS. 1 through 4, the tape printer 1 is provided with a device main body case 10 forming a principal outer envelope thereof, a transport assembly 11 incorporated in the device main body case 10, the tape cartridge 12 detachably attached inside the transport assembly 11, a device-side brake mechanism 13 (see FIGS. 5 and 10) for applying the back tension to an ink ribbon 61 fed from a ribbon cartridge 17, a device-side brake transmission mechanism 14 (see FIGS. 5 and 10) for transmitting the braking force of the device-side brake mechanism 13 to the ink ribbon 61, the lid case 15 disposed so as to cover above the device main body case 10 in an openable and closable manner, a printing assembly 16 incorporated in the lid case 15, and the ribbon cartridge 17 detachably attached inside the printing assembly 16.

Further, a control device (not shown) for controlling the drive of each of the constituents is incorporated in the tape printer 1. Further, a control terminal 18 (e.g., a personal computer) is connected to the tape printer 1 via a connection port, and the user operates the tape printer 1 via the control terminal 18 to thereby make the tape printer 1 perform the printing operation. It should be noted that the device main body case 10 and the lid case 15 constitute a device case forming an overall appearance of the tape printer 1.

At the front center of the device main body case 10, there is disposed a sheet discharge opening 20 for discharging a printing tape 32 printed to the outside. The printing tape 32 is fed from the tape cartridge 12 disposed in a back part, and is provided for printing in the process of being transported toward the sheet discharge opening 20.

Transport Assembly

The transport assembly 11 is provided with a tape mounting section 21 on which the tape cartridge 12 is mounted, the tape transport mechanism 22 (see FIGS. 4 and 5) for transporting the printing tape 32 while taking it out from the tape cartridge 12, a cutter mechanism 23 for cutting the printing tape 32 on which printing has been performed, and a tape detection mechanism 24 for detecting presence or absence of the printing tape 32 fed on the transport path.

The tape mounting section 21 is formed in the back portion of the device main body case 10 so as to be recessed inside, and is arranged to make it possible to set the tape cartridge 12 at a so-called centered position (a center position in the lateral direction).

As shown in FIGS. 3 through 5, the tape transport mechanism 22 is disposed in front of the tape mounting section 21, and has a so-called platen roller 22*a* and the transport driving device 22*b* for rotationally driving the platen roller 22*a*. The platen roller 22*a* has contact with a lower surface of the printing tape 32 fed out from the tape cartridge 12, and transports the printing tape 32 (see the dashed line in FIG. 4(*a*)) to the sheet discharge opening 20 communicating in front thereof in cooperation with a thermal head 521 described later.

As shown in FIG. 5, the transport driving device 22*b* has a DC motor 221 acting as a power source, a worm gear 222 coupled to an output shaft of the DC motor 221, a worm wheel gear 223 engaged with the worm gear 222, a platen-side gear train 224 for transmitting the rotational force to the platen roller 22*a*, and a wind-up gear train 225 for transmitting the rotational force to a wind-up core 63 of the ribbon cartridge 17 described later. The transport driving device 22*b* rotates the platen roller 22*a* and the wind-up core 63 in sync with each other.

The platen-side gear train 224 has a platen input gear 226 engaged with the worm wheel gear 223, and a platen output gear 227 engaged with the platen input gear 226 and at the same time pivoted at (rotatably attached to) an end of the platen roller 22*a*.

The wind-up gear train 225 has a wind-up input gear train 228 engaged with the worm wheel gear 223, and a wind-up output gear 229 engaged with a gear on the output side of the wind-up input gear train 228, and at the same time engaged with a wind-up gear 77 (described later) of a wind-up driving transmission mechanism 75 coupled to the wind-up core 63.

Needless to say, backlash exists between the respective gears. Therefore, a play caused by the backlash causes a minor slip in the rotational direction of the platen roller 22*a*. The tape printer 1 (the control device) according to the present embodiment performs the drive control of the DC motor 221 for eliminating the play caused by the backlash prior to the commencement of printing and before and after the cutter mechanism 23 cuts the tape. It should be noted that the backlash between the worm gear 222 and the worm wheel gear 223 as screw gears can be neglected, and it is unachievable to rotate the worm gear 222 even by applying rotational force to the platen roller 22*a*.

As shown in FIG. 4, the cutter mechanism 23 is a so-called scissors type having a stationary blade and a movable blade facing vertically to each other across the printing tape 32, and is disposed in front of the platen roller 22*a*. The printing tape 32 the printing process on which has been completed is cut by the cutter mechanism 23, and is then discharged to the outside from the sheet discharge opening 20.

As shown in FIGS. 2 and 4, the tape detection mechanism 24 is a so-called reflective photo sensor, and has a first photoelectric element 26 incorporated in a first sliding member 25 disposed between the tape cartridge 12 and the tape transport mechanism 22, and a second photoelectric element 28 incorporated in a second sliding member 27 disposed at the sheet discharge opening 20 in front of the cutter mechanism 23. The first photoelectric element 26 and the second photoelectric element 28 are disposed so as to be exposed to the lower surface of the printing tape 32.

Although not shown in the drawings, the first photoelectric element 26 and the second photoelectric element 28 each have a light emitting element and a light receiving element, and detect presence or absence of each of detection target holes 323 described later and the printing tape 32 based on whether or not the light emitted from the light emitting element is received by the light receiving element. If the printing tape 32 runs out, and the first photoelectric element 26 fails to receive the reflected light (continues to detect a sensor-facing section 841 (a label sticker 842)), the tape printer 1 (the control device) according to the present embodiment stops the tape transport mechanism 22 and a printing mechanism 52.

Specifically, the feeding of the printing tape 32 (a label 322) is performed in accordance with the first photoelectric element 26 detecting each of the detection target holes 323, and so-called tape end detection is performed in accordance with the first photoelectric element 26 detecting presence or absence of the printing tape 32. By performing the tape end detection, so-called idle printing can be prevented, and the deterioration and the damage of the platen roller 22*a* and the thermal head 521 due to the idle printing can effectively be prevented. Further, the second photoelectric element 28 detects the discharge of the printing tape 32.

The first sliding member 25 and the second sliding member 27 function as the path (the transport path) with which the printing tape 32 fed out has sliding contact, and along which the printing tape is transported, and are formed to have a width roughly the same as the maximum width of the printing tape 32 and have a tabular shape. Further, a first opening section 25*a* forming a light path for the first photoelectric element 26 is formed at a rough lateral center of the first sliding member 25, and a second opening section 27*a* forming a light path for the second photoelectric element 28 is similarly formed in the second sliding member 27. The light emitting element and the light receiving element (not shown) of the first photoelectric element 26 are disposed in the first opening section 25*a* so as not to project from the upper end surface of the first sliding member 25, and the light emitting element and the light receiving element (not shown) of the second photoelectric element 28 are similarly disposed in the second opening section 27*a* so as not to project from the upper end surface of the second sliding member 27.

As described above, the tape detection mechanism 24 is arranged to be able to detect the printing tape 32 on each of the sliding members 25, 27, and at the same time, to keep the distance between each of the photoelectric elements 26, 28 and the printing tape 32 constant. According to the above configuration, even in the case in which the printing tape 32 in transportation slightly fluctuates on the transport path, the distance between the printing tape 32 and each of the photoelectric elements 26, 28 can be kept constant, and it is possible to perform reliable and stable detection of the printing tape 32. It should be noted that it is also possible to eliminate the first sliding member 25 and the second sliding member 27 in order to minimize the diffusion and reflection of the light.

Tape Cartridge

Figure 6:
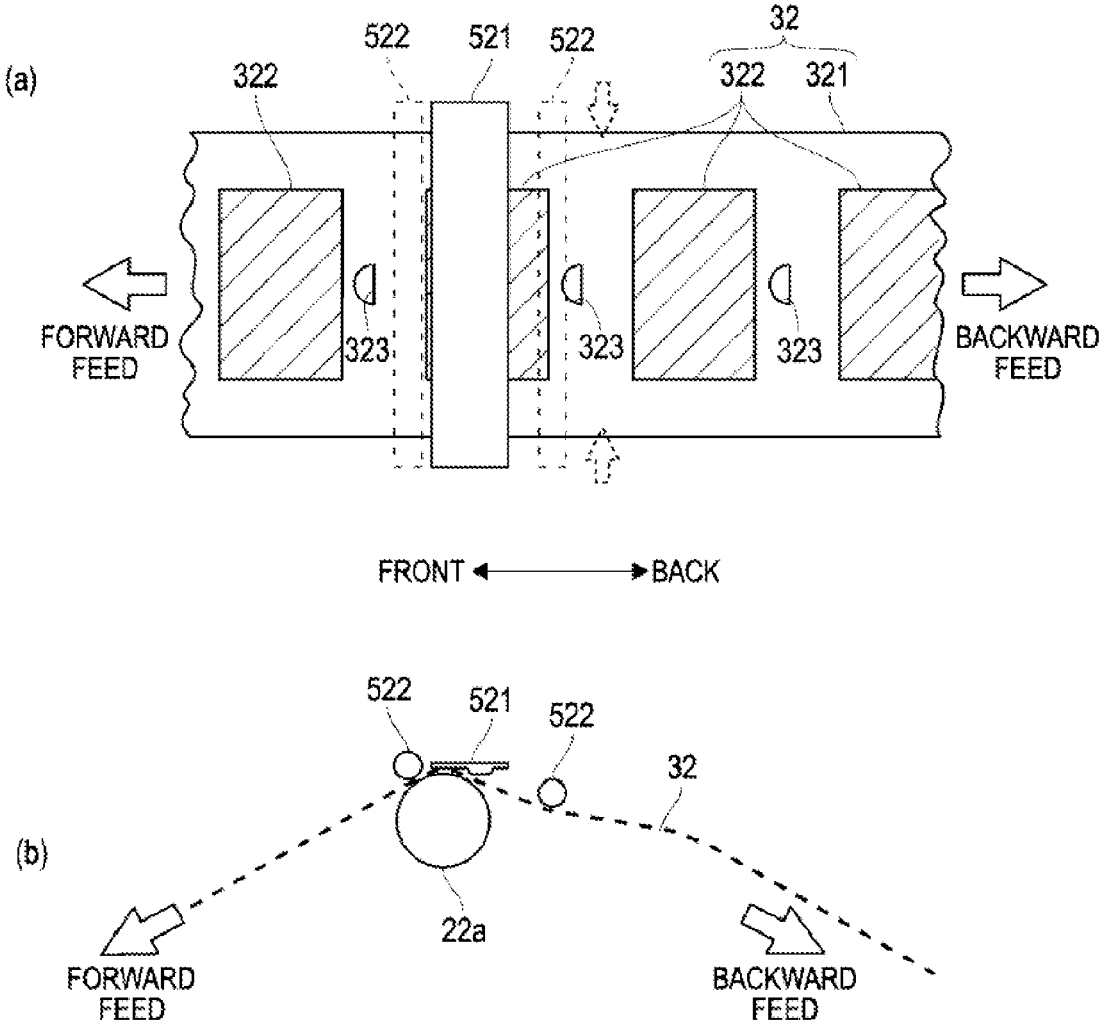
FIG. 6(*a*) is a plan view of a printing tape and a thermal head, and FIG. 6(*b*) is a side view of the printing tape, the thermal head, and a platen roller.
Figure 7:
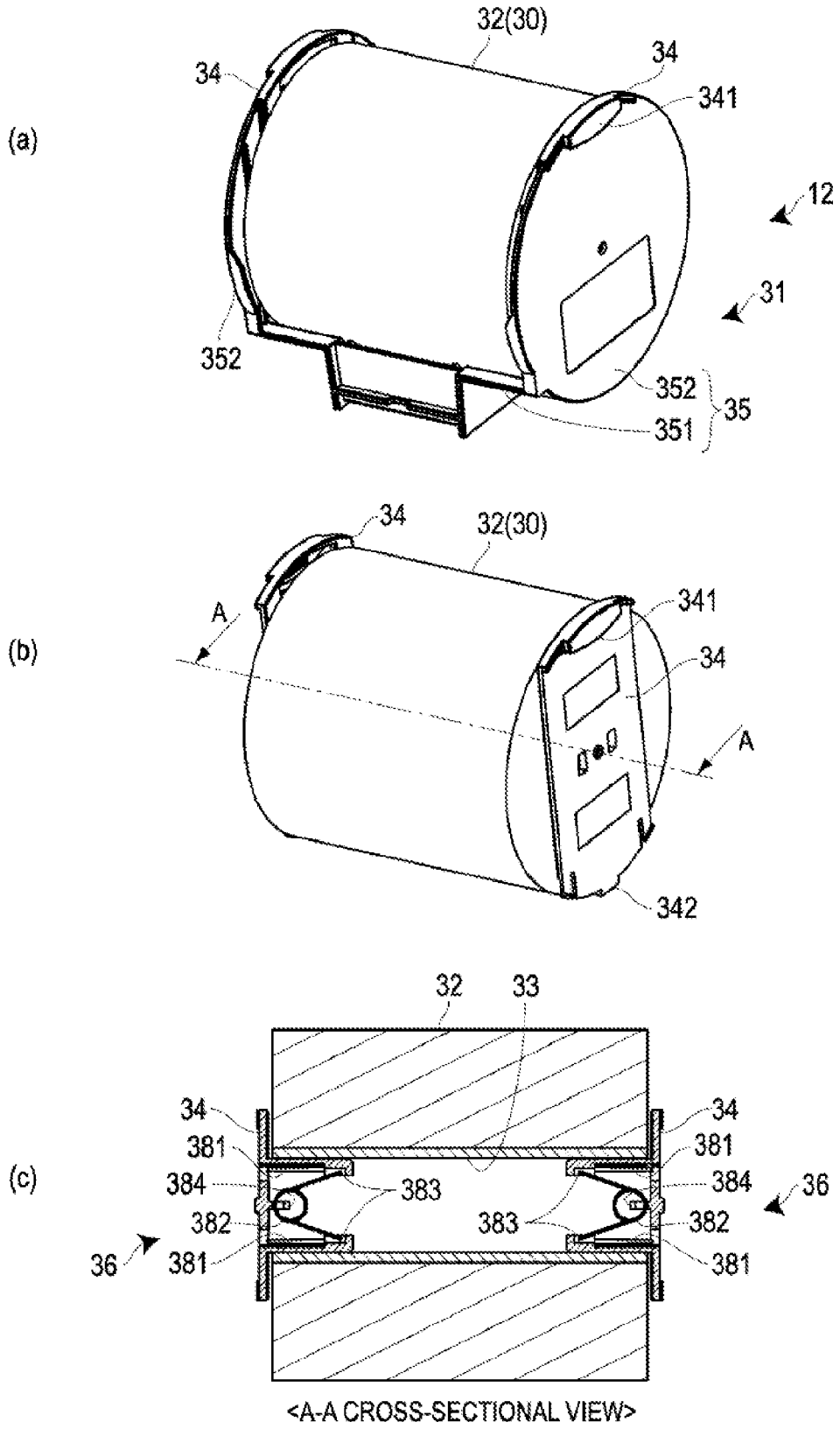
FIG. 7(*a*) is a perspective view of the tape cartridge, FIG. 7(*b*) is a perspective view of a tape body and shaft holders, and FIG. 7(*c*) is a cross-sectional view of FIG. 7(*b*) along the A-A line.
Figure 8:
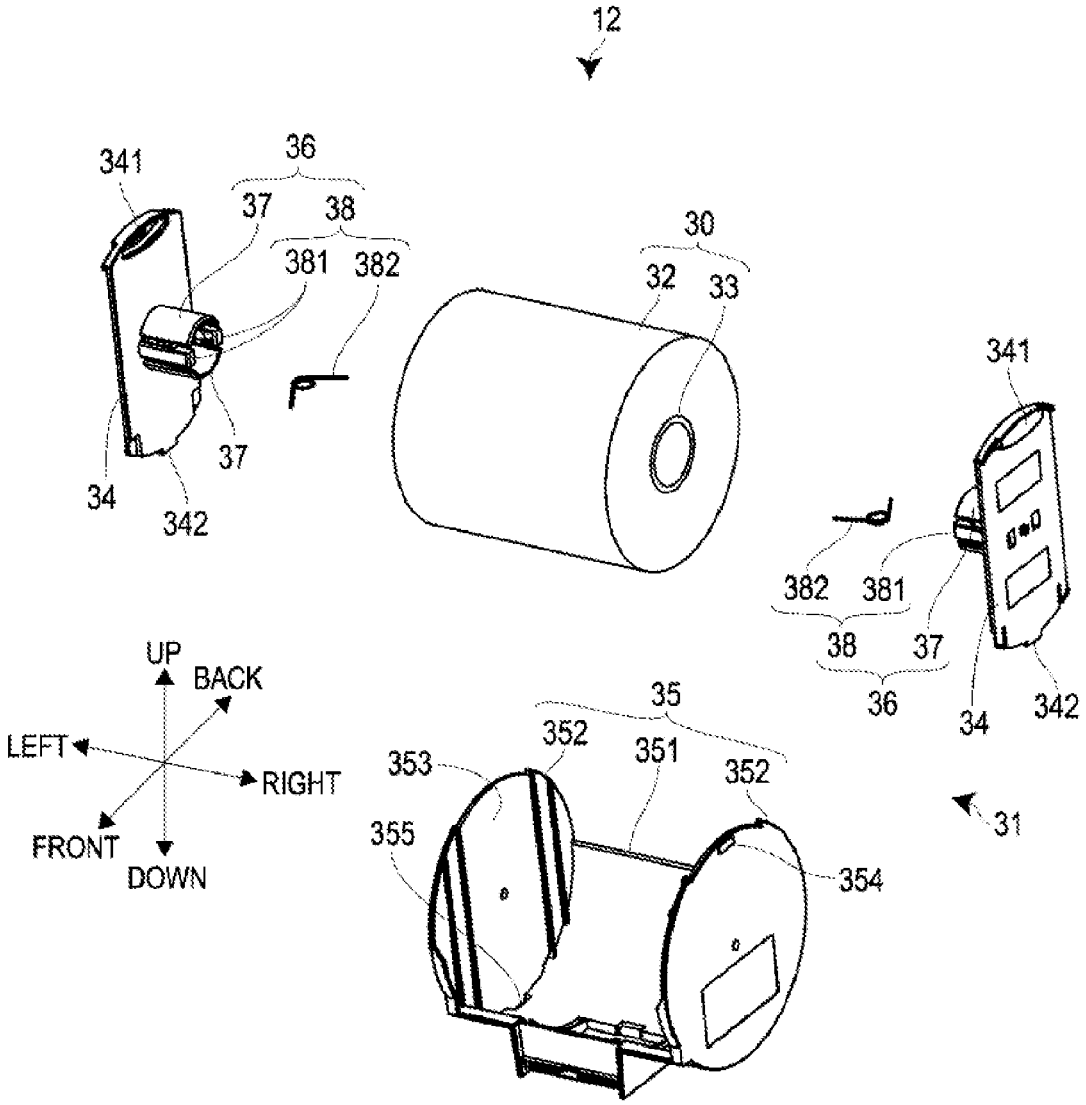
FIG. 8 is an exploded perspective view of the tape cartridge.
Figure 9:
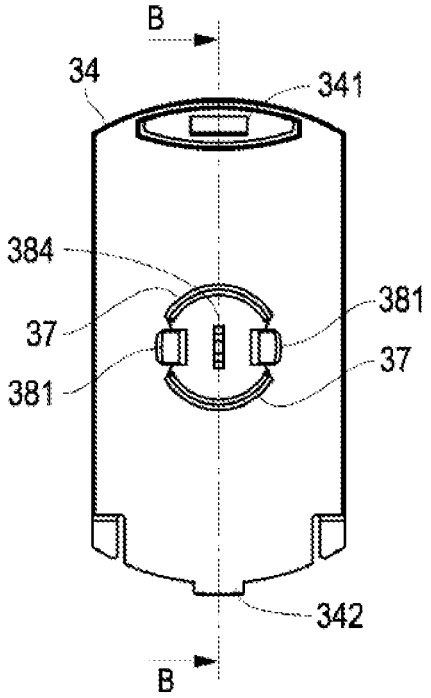
FIG. 9(*a*) is a front view of the shaft holder, and FIG. 9(*b*) shows a side view of the shaft holder and a cross-sectional view of FIG. 9(*a*) along the B-B line.
Figure 9:
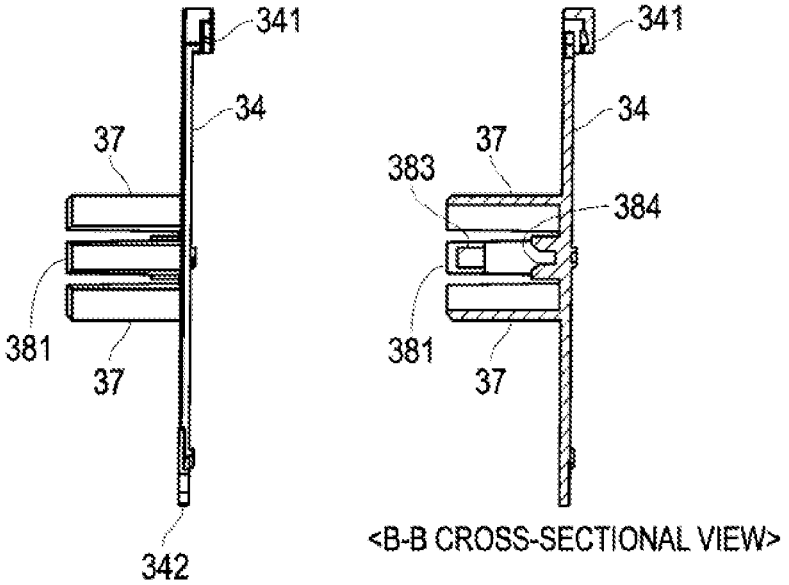

Subsequently, the tape cartridge 12 will be explained in detail with reference to FIGS. 2, 4, and 6 through 9. FIG. 6(*a*) is a plan view of the printing tape 32 and the thermal head 521, and FIG. 6(*b*) is a side view of the printing tape 32, the thermal head 521, and the platen roller 22*a*. FIG. 7(*a*) is a perspective view of the tape cartridge 12, FIG. 7(*b*) is a perspective view of a tape body 30 and shaft holders 34, and FIG. 7(*c*) is a cross-sectional view of FIG. 7(*b*) along the A-A line. FIG. 8 is an exploded perspective view of the tape cartridge 12. FIG. 9(*a*) is a front view of the shaft holder 34, and FIG. 9(*b*) shows a side view of the shaft holder 34 and a cross-sectional view of FIG. 9(*a*) along the B-B line.

The tape cartridge 12 is provided with the tape body 30 having the printing tape 32 wound around a tape core 33, and a cartridge case 31 rotatably supporting the tape core 33. It should be noted that the tape cartridge 12 is detachably attached to the tape mounting section 21. The tape cartridge 12 houses the printing tape 32 of a type different in width, color, and so on. Further, taking user friendliness into consideration, so-called paper rolls and die-cut tapes are prepared.

As shown in FIG. 6(*a*), the printing tape 32 is a so-called die-cut tape having a plurality of labels 322 stuck on elongated release paper 321 at regular intervals. The release paper 321 is formed to be thinner with lower rigidity than the labels 322.

A plurality of detection target holes 323 is formed at regular intervals at respective portions of the release paper 321 between the labels 322. The plurality of detection target holes 323 is detected by the tape detection mechanism 24 described above. Due to the tape detection mechanism 24 detecting each of the detection target holes 323, printing timing of each of the labels 322 is calculated, and the accurate printing without displacement is performed.

Each of the detection target holes 323 is formed at a middle position in the width direction of the release paper 321 (the printing tape 32) so as to penetrate the release paper 321 in the thickness direction thereof. Each of the detection target holes 323 is formed so that a hole end on the trailing side in the forward feed direction of the printing tape 32 is parallel to the width direction, and a hole end on the leading side in the forward feed direction is shaped like a circular arc (nonparallel) with respect to the width direction. In other words, each of the detection target holes 323 is formed to have a "D" shape in a plan view. It should be noted that the "forward feed" denotes the transportation of the printing tape 32 in the normal printing operation, and "backward feed" denotes the transportation in the direction opposite to the forward feed.

Here, when transporting the printing tape 32 provided with the plurality of detection target holes 323, there is a case in which a tiny force component for shifting the printing tape 32 toward the center (the center in the width direction) acts on the printing tape 32 (see the dashed arrow in FIG. 6(*a*)), and the hole end on the trailing side in the feed direction is hooked by the thermal head 521 or a ribbon path changing shaft 522, and the printing tape 32 is damaged (see FIG. 6(*b*)). Therefore, in the printing tape 32 according to the present embodiment, the "D" shape is adopted as the planar shape of each of the detection target holes 323 to thereby prevent the hooking and the damage of the printing tape 32 described above.

Specifically, when backward feed of the printing tape 32 is performed, regarding the hole end on the leading side in the backward feed direction, holding by the platen roller 22*a* is effective for suppressing the protrusion of the hole end, and regarding the hole end on the trailing side in the backward feed direction, holding by the platen roller 22*a* becomes gradually effective, and the protrusion of the hole end is finally suppressed. On the other hand, regarding the hole end on the leading side in the forward feed direction, holding by the platen roller 22*a* is effective for suppressing the protrusion of the hole end, and regarding the hole end on the trailing side in the forward feed direction, when a part of the platen roller 22*a* reaches the detection target hole 323, a part of an outer periphery thereof is deformed to enter the detection target hole 323, and forcibly spread the detection target hole 323 to thereby suppress the protrusion. In other words, by making the hole end on the leading side in the forward feed direction (on the trailing side in the backward feed direction) have a circular arc shape (nonparallel) with respect to the width direction, it is possible to make the holding of the platen roller 22*a* effectively act on the detection target hole 323 and the periphery thereof, and to effectively prevent the detection target hole 323 from being hooked by the thermal head 521 and so on.

Further, since the circular arc portion of the detection target hole 323 acts as the shape resisting the tiny force component for shifting the printing tape 32 to the center (the center in the width direction) caused in the feed by the platen roller 22*a*, it is possible to reduce the protrusion caused in both of the hole ends as much as possible. Further, since the hole end on the trailing side in the forward feed direction (the leading side in the backward feed direction) is formed to be parallel to the width direction, the position of the detection target hole 323 can accurately be detected by the tape detection mechanism 24 (the first photoelectric element 26 and the second photoelectric element 28).

Although the details will be described later, in the present embodiment, the backward feed of the printing tape 32 is performed in some cases. In such cases, since the printing tape 32 on the upstream side in the backward feed direction reaches the sheet discharge opening 20, no back tension is applied to the printing tape 32. If the printing tape 32 is fed by the platen roller 22*a* without applying the back tension, the tiny force component for shifting the printing tape 32 to the center directly acts on the printing tape 32. Even in such a case, by using the printing tape 32 according to the present embodiment, it is possible to make the holding by the platen roller 22*a* effectively act on the detection target hole 323 and the periphery thereof.

It should be noted that since it is sufficient for the detection target hole 323 to have the hole end on the leading side in the forward feed direction (on the trailing side in the backward feed direction) nonparallel to the width direction, the shape of the detection target hole 323 is not limited to the circular arc shape, but can be formed as a shape having a number of corners, or the shape of the opening of the detection target hole 323 can be set to a triangle. Further, although in the present embodiment the die-cut tape is used, besides the die-cut tape, there can be used the printing tape 32 having a adhesive layer and a release layer on the reverse side of the printing side, and used for forming a label by cutting the portion on which the printing has been performed using the cutter mechanism 23. It should be noted that a thermal paper roll can also be used as the printing tape 32. In this case, the ribbon cartridge 17 can be eliminated.

As shown in FIGS. 7 and 8, the tape body 30 forms a so-called face-in roll configuration having the printing tape 32 wound around the outer periphery of the tape core 33 made of paper and shaped like a hollow circular cylinder with the printing side facing inside. Further, the tape body 30 is rotatably pivoted by the shaft holders 34 respectively located on both ends in the axial direction of the tape core 33. As described above, since the printing tape 32 is wound with the labels 322 to be the recording side facing inside, it is possible to prevent the labels 322 from getting dirty or being damaged before printing. It should be noted that on both end surfaces of the tape body 30, there are stuck adhesive sheets (not shown) for preventing the printing tape 32 thus wound from loosening, respectively.

The cartridge case 31 has a pair of brake mechanisms 36 for pivoting both of the ends of the tape body 30 (the tape core 33), a pair of shaft holders 34 each attached with the brake mechanism 36 projecting in an inward direction, and a main body case 35 for housing the tape body 30 together with the pair of shaft holders 34.

As shown in FIGS. 7 through 9, each of the shaft holders 34 is formed to have a plate-like shape, and is attached with the brake mechanism 36 at a rough center thereof so as to project therefrom. The pair of shaft holders 34 is positioned so as to pinch the tape body 30 inside from both of the ends thereof, and pivots the tape core 33 via the pair of brake mechanisms 36 (a roll shaft 37).

As shown in FIGS. 7 and 8, the main body case 35 has a tape cover section 351 for covering a lower peripheral surface of the tape body 30, and a pair of sidewall sections 352 erected at both lateral ends of the tape cover section 351. The tape cover section 351 is formed to have a back part curved along the peripheral surface of the tape body 30. Each of the sidewall sections 352 is formed to have a disk-like shape with a diameter larger than that of the tape body 30. It should be noted that the lower surface of the tape cover section 351 is provided with a plurality of projections (not shown) as a detection target section for detecting the type of the printing tape 32.

A roughly central portion in a front-back direction of an inward surface of each of the sidewall sections 352 is provided with a positioning groove 353 slightly hollowed throughout the sidewall section 352 in a vertical direction to have a shape roughly complementary to the shaft holder 34. It is arranged that when fitting the pair of shaft holders 34 pivoting the tape body 30 into the positioning grooves 353 of the respective sidewall sections 352, the tape body 30 and the sidewall sections 352 are positioned coaxially.

Further, an outward upper end portion of each of the sidewall sections 352 is provided with an engaging projection 354 with which an engaging head section 341 in the upper part of the shaft holder 34 is engaged, and the tape cover section 351 is provided with a pair of engaging holes 355, with which engaging salients 342 at the lower ends of the respective shaft holders 34 are engaged, formed at the portions, where the respective sidewall sections 352 are erected, so as to penetrate the tape cover section 351.

As shown in FIGS. 7 through 9, each of the brake mechanisms 36 is disposed at a rough center of the shaft holder 34 so as to project therefrom, and has the roll shaft 37 for pivoting the tape core 33, and a braking section 38 incorporated in the roll shaft 37 and having sliding contact with the inner peripheral surface of the tape core 33 in a rotating state to apply a rotational braking force to the tape body 30.

Each of the roll shafts 37 is formed to have a roughly hollow circular cylinder shape as a while, and has an outer diameter with which the roll shaft 37 can have sliding contact with the inner peripheral surface of the tape core 33.

Each of the braking sections 38 has a pair of spring elements 381 having elasticity formed in a part of the roll shaft 37 so as to extend in the axial direction, and a braking spring 382 for biasing the pair of spring elements 381 toward the inner peripheral surface of the tape core 33.

The pair of spring elements 381 is each formed of a part of the roll shaft 37 separated by a pair of slits cut into in the axial direction at front and back positions (180 degrees symmetrical positions) of each of the roll shafts 37. In the inside of tip portions of the pair of spring elements 381, there are formed hooking stoppers 383 for hooking to stop a pair of ends of the wire material of the braking spring 382.

Each of the spring elements 381 is a part of the roll shaft 37, and is therefore formed to have a circular arc shape in the circumferential direction. Therefore, since the spring elements 381 have sliding contact with the inner peripheral surface of the tape core 33, there is no chance of damaging the inner peripheral surface of the tape core 33 made of paper. Thus, it is possible to stably obtain a desired rotational load (the braking force). Further, since the part of the roll shaft 37 also functions as the spring element 381, it is possible to rotatably pivot the tape body 30 while applying the rotational load to the tape body 30 (the tape core 33). Thus, it is possible to easily constitute the braking section 38 with a small number of components.

The braking spring 382 is formed of a so-called torsion coil spring. Each of the braking springs 382 is fixed with a wire material coiled portion positioned by a spring positioning section 384 disposed at a shaft center base portion of the roll shaft 37, and the pair of wire material ends hooked to be stopped by the hooking stopper 383 described above. By each of the braking springs 382 pressing the pair of spring elements 381 against the inner peripheral surface of the tape core 33 at a predetermined force, the load is applied to the rotation of the tape core 33 (the tape body 30). It should be noted that the other part of the roll shaft 37 than the pair of spring elements 381 has sliding contact with the inner peripheral surface of the tape core 33 in the rotating state to thereby stabilize the rotation of the tape core 33 (the tape body 30).

As described above, the biasing force of each of the braking springs 382 acts on the inner peripheral surface of the tape core 33 via the pair of spring elements 381. Each of the spring elements 381 can freely be set taking the material of the tape core 33 and the contact area with the inner peripheral surface into consideration. Thus, it is possible to press the spring elements 381 against the inner peripheral surface of the tape core 33 with a stable biasing force to thereby keep the stable sliding contact state. Further, by disposing the pair of spring elements 381 at symmetrical positions of the roll shaft 37, a balanced rotational load without bias can be applied to the tape body 30 (the tape core 33).

It should be noted that although the pair of spring elements 381 are disposed at the 180 degrees symmetrical positions in the present embodiment since the torsion coil springs are used as the braking springs 382, it is preferable to arbitrarily set the formation positions and the number (one or more) of spring elements 381 in accordance with the type of the braking springs 382, and the positions and the number of the wire material ends. For example, there can be cited the case of disposing the three spring elements 381 at 120 degrees intervals, the case of disposing the four spring elements 381 at 90 degrees intervals, and the case of disposing the five spring elements 381 at 72 degrees intervals. Further, it is also possible to eliminate the braking springs 382, and to brake the tape body 30 (the tape core 33) only with one or more spring elements 381 having elasticity.

Device-Side Brake Mechanism and Device-Side Brake Transmission Mechanism

Figure 10:
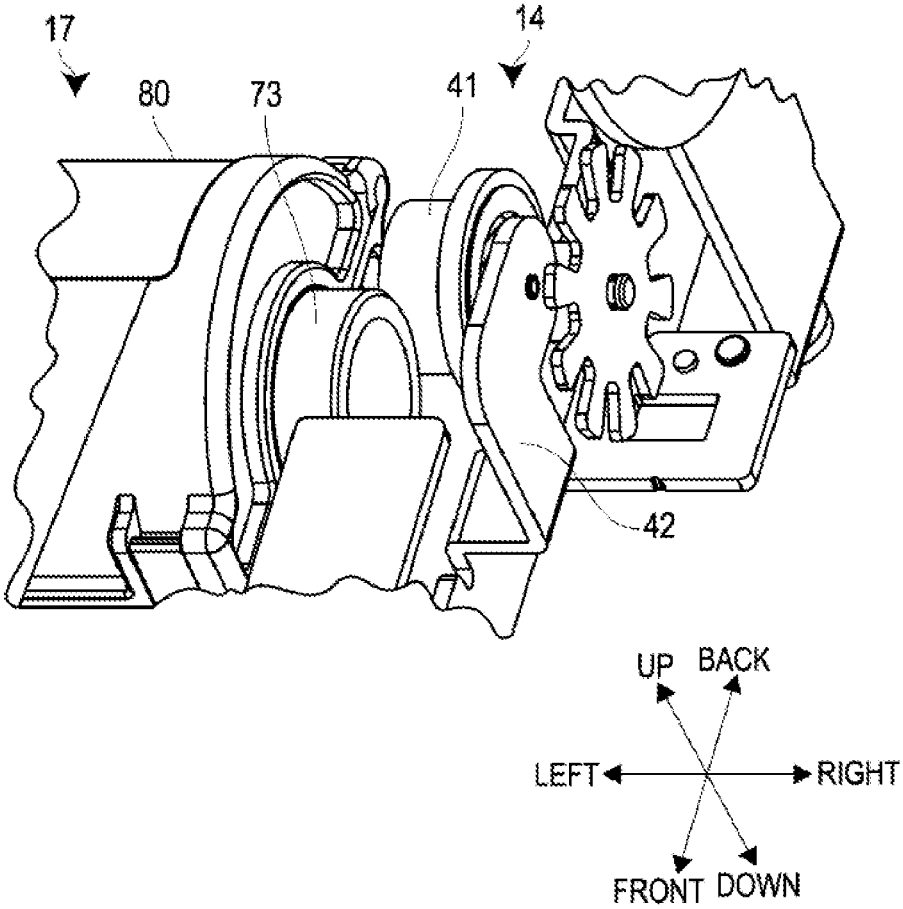
FIG. 10(*a*) is a perspective view of a device-side brake mechanism and a device-side brake transmission mechanism, and FIG. 10(*b*) is an exploded perspective view of the device-side brake mechanism and the device-side brake transmission mechanism.
Figure 10:
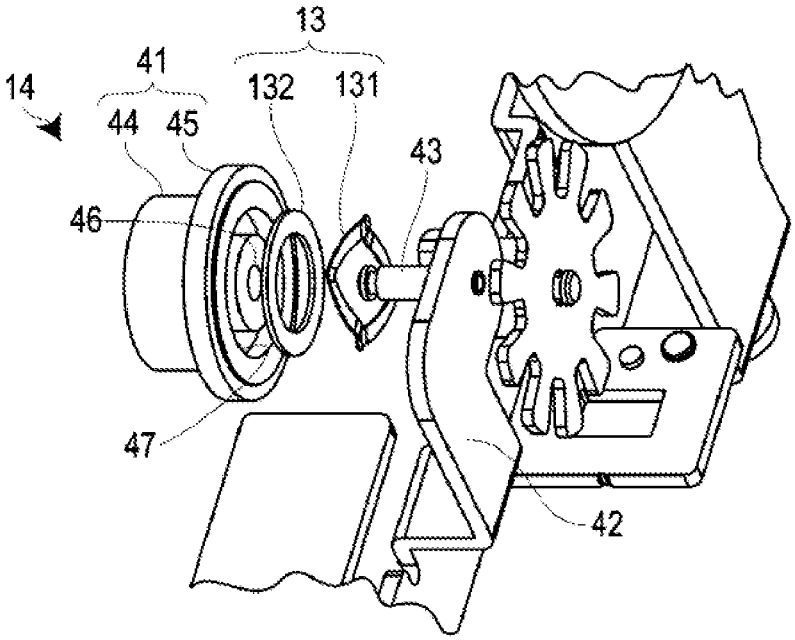

Then, the device-side brake mechanism 13 and the device-side brake transmission mechanism 14 will be explained with reference to FIG. 10. FIG. 10(*a*) is a perspective view of the device-side brake mechanism 13 and the device-side brake transmission mechanism 14, and FIG. 10(*b*) is an exploded perspective view of the device-side brake mechanism 13 and the device-side brake transmission mechanism 14.

As shown in FIG. 10(*b*), the device-side brake mechanism 13 has a device-side plate spring 131 having a ring-like shape, and a seal 132 having a ring-like shape and for stabilizing the sliding friction with the device-side plate spring 131.

As shown in FIG. 10, the device-side brake transmission mechanism 14 has a device-side gear 41 releasably engaged (in the manner in which the gears can be engaged with each other and separated from each other) with a feed-out gear 73 of a feed-out brake transmission mechanism 71 of the ribbon cartridge 17 described later, and a device-side pivot 43 supported by a frame 42 of the tape printer 1 and for rotatably supporting the device-side gear 41.

The device-side gear 41 has a gear main body 44 having a plurality of gear teeth formed on the peripheral surface, and a flange section 45 formed on the frame 42 side of the gear main body 44 to have a diameter larger than that of the gear main body 44. At the center of the device-side gear 41, there is formed a shaft hole 46 so as to penetrate therethrough in which the device-side pivot 43 is inserted, and thus, the device-side gear 41 is rotatably supported by the device-side pivot 43.

On the flange section 45 side of the device-side gear 41, there is formed a ring-like recessed section 47 in a hollow manner in which the device-side brake mechanism 13 is mounted. The seal 132 and the device-side plate spring 131 are fitted in the ring-like recessed section 47 in this order. Further, when making the device-side pivot 43 pivot the device-side gear 41 with the device-side brake mechanism 13 mounted into the ring-like recessed section 47, the device-side plate spring 131 is positioned between the bottom of the ring-like recessed section 47 and the frame 42. In other words, by the device-side plate spring 131 having sliding contact with both of the bottom of the ring-like recessed section 47 and the frame 42, the load (the braking force) is applied to the rotation of the device-side gear 41.

It should be noted that since the device-side plate spring 131 has sliding contact with the bottom of the ring-like recessed section 47 via the seal 132, the ware of the bottom surface can be prevented. Further, moreover, the braking force caused by the device-side brake mechanism 13 is set to be smaller than the braking force caused by the cartridge-side brake mechanism 65 (to be precise, a feed-out brake mechanism 65*a*) described later.

Lid Case

As shown in FIGS. 1 though 4, the lid case 15 is rotatably disposed so that the front portion is tipped up around a hinge 15*a* disposed in the back end portion, and is used as an open-close lid for releasing the transport assembly 11 (the tape mounting section 21). Further, by releasing the lid case 15, it results that the printing assembly 16 (the ribbon mounting section 51) is released. Thus, the replacement of the tape cartridge 12 and the ribbon cartridge 17 becomes possible, and at the same time, the maintenance of each of the mechanisms becomes possible.

Printing Assembly

As shown in FIGS. 2 and 4, the printing assembly 16 is provided with a ribbon mounting section 51 on which the ribbon cartridge 17 is mounted, and the printing mechanism 52 for performing the printing process on the printing tape 32.

Inside the lid case 15, the ribbon mounting section 51 has a feed-out mounting section 511 formed on the backside of the printing mechanism 52 in a hollow manner, and a wind-up mounting section 512 formed on the front side of the printing mechanism 52 in a hollow manner. In other words, the ribbon cartridge 17 is mounted on the ribbon mounting section 51 so as to straddle the printing mechanism 52. It should be noted that the feed-out mounting section 511 is located nearer to the front side (lower in the closed state of the lid case 15) than the wind-up mounting section 512 in FIGS. 2 and 3.

The printing mechanism 52 is composed of a so-called thermal head 521, a head driving device (not shown) for controlling drive of the thermal head 521, and a pair of ribbon path changing shafts 522 disposed in front of and behind the thermal head 521 so that the ink ribbon 61 faces heat generating sections of the thermal head 521, and for changing the running path 66 of the ink ribbon 61. The thermal head 521 is disposed so as to have sliding contact with the printing tape 32 from the upper side via the ink ribbon 61 at the position where the platen roller 22*a* is disposed (see FIG. 4).

Ribbon Cartridge

Figure 11:
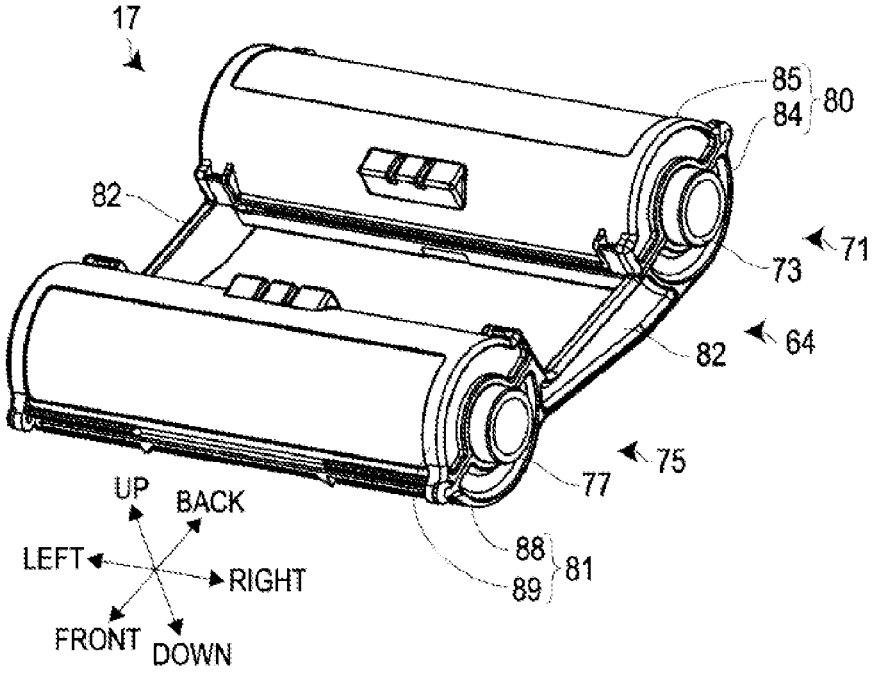
FIG. 11 shows perspective views of the ribbon cartridge.
Figure 11:
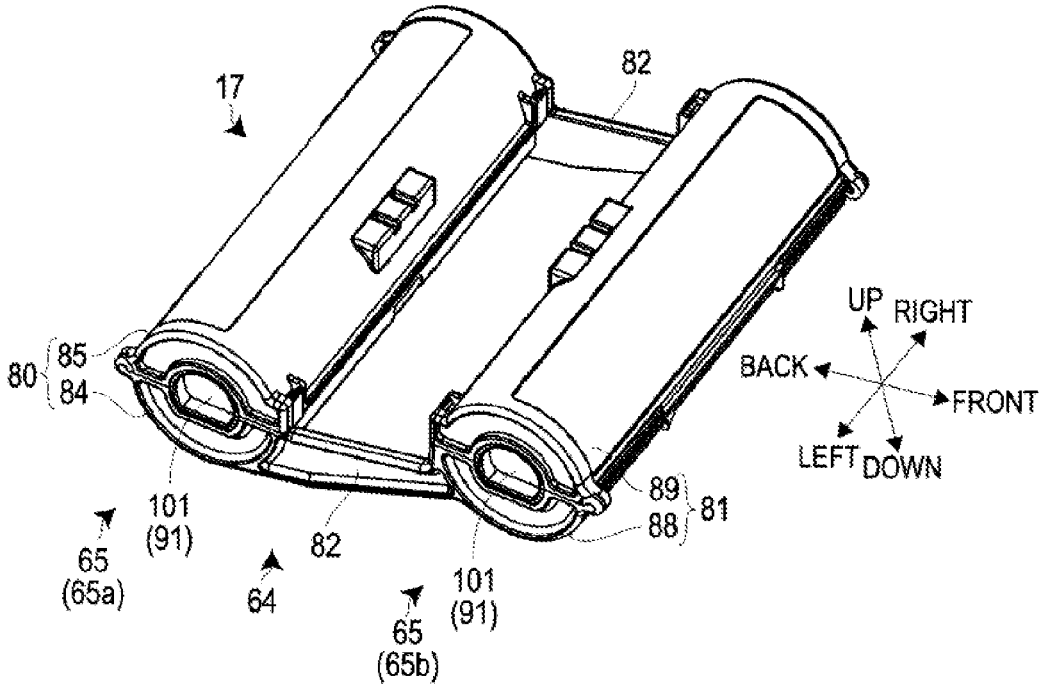
Figure 12:
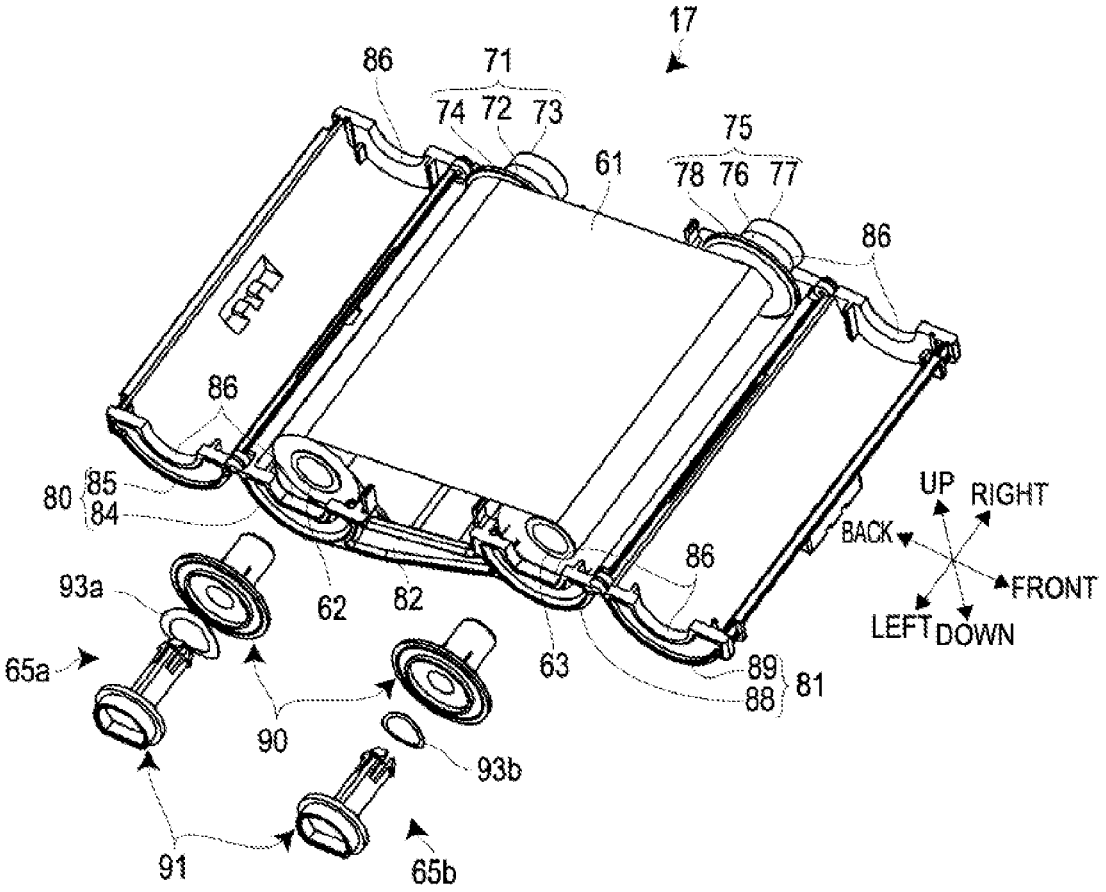
FIG. 12 is an exploded perspective view of the ribbon cartridge.
Figure 13:
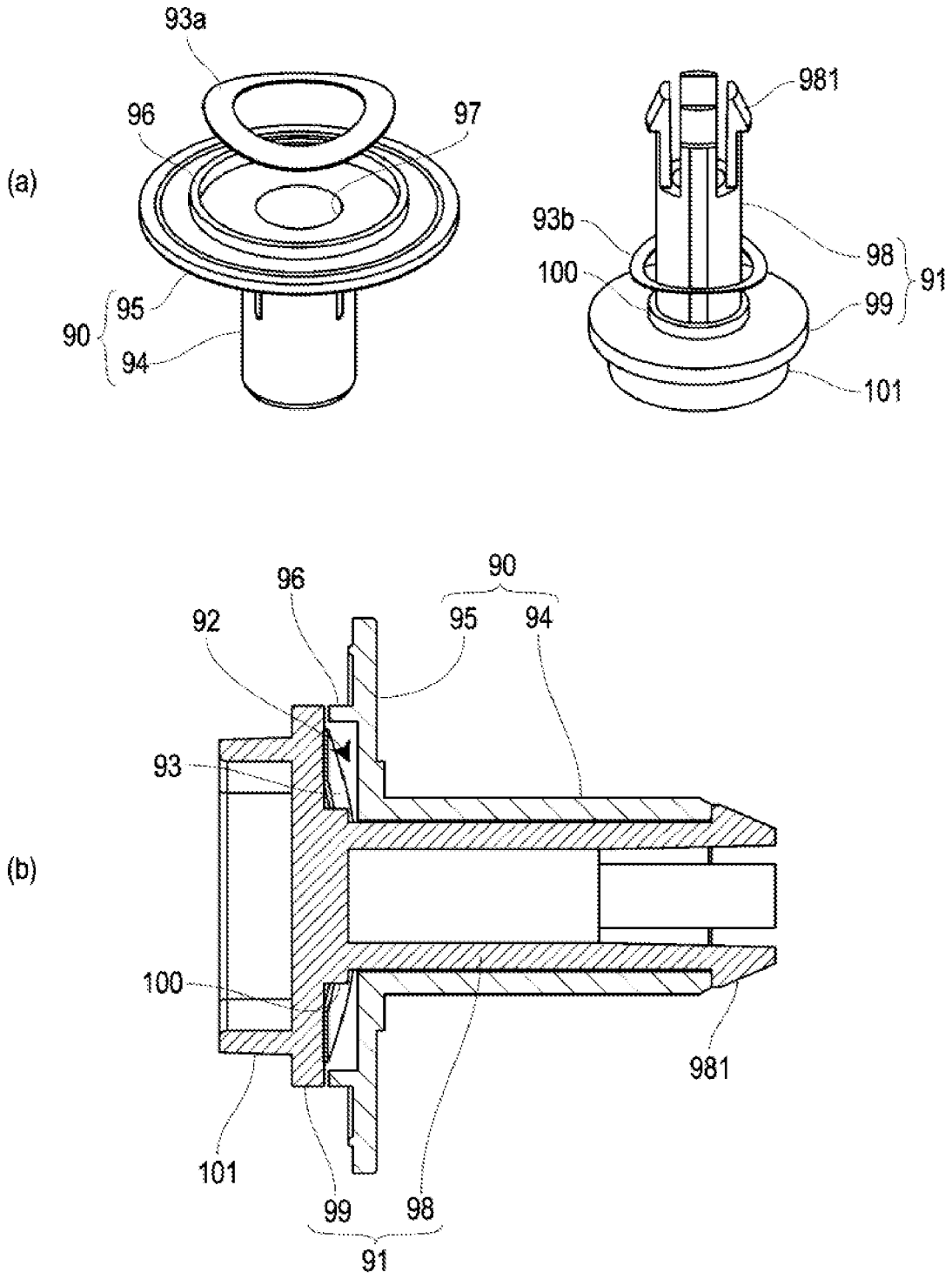
FIG. 13(*a*) is an exploded perspective view of a cartridge-side brake mechanism, and FIG. 13(*b*) is a cross-sectional view of the cartridge-side brake mechanism.

Then, the ribbon cartridge 17 will be explained with reference to FIGS. 2, 4, and 11 through 13. FIG. 11 is a perspective view of the ribbon cartridge 17. FIG. 12 is an exploded perspective view of the ribbon cartridge 17. FIG. 13(*a*) is an exploded perspective view of the cartridge-side brake mechanism 65, and FIG. 13(*b*) is a cross-sectional view of the cartridge-side brake mechanism 65.

As shown in FIGS. 2 and 4, the ribbon cartridge 17 is provided with a ribbon body 60 having the ink ribbon 61 wound around a feed-out core 62, the wind-up core 63 for winding up the ink ribbon 61 having been used, a ribbon case 64 for rotatably supporting the feed-out core 62 and the wind-up core 63, and a cartridge-side brake mechanism 65 (see FIG. 11(*b*)) for applying a braking force to the ribbon body 60 (the feed-out core 62) and the wind-up core 63.

As shown in FIGS. 11 and 12, the feed-out core 62 and the wind-up core 63 are each formed to have a hollow circular cylinder shape. The feed-out brake transmission mechanism 71 is attached to the right end of the feed-out core 62, and the wind-up driving transmission mechanism 75 is attached to the right end of the wind-up core 63.

The feed-out brake transmission mechanism 71 is fitted to be fixed to the shaft center of the feed-out core 62, and has a feed-out pivot 72 (a cartridge-side pivot) rotatably supported by a sidewall section 352 of the ribbon case 64, and the feed-out gear 73 (a cartridge-side gear) axially attached to the feed-out pivot 72.

The feed-out pivot 72 has a feed-out flange section 74 having contact with the right end surface of the feed-out core 62 (the ribbon body 60), and at the same time, having sliding contact with an inner right side surface of a feed-out case section 80 described later. The feed-out gear 73 is engaged with the device-side gear 41 of the device-side brake transmission mechanism 14 described above in the closed state of the lid case 15 (see FIG. 5). Thus, the load (torque) from the device-side brake mechanism 13 acts on the rotation of the feed-out core 62, and the load applies the back tension to the ink ribbon 61.

Similarly, the wind-up driving transmission mechanism 75 is fitted to be fixed to the shaft center of the wind-up core 63, and has a wind-up pivot 76 rotatably supported by the sidewall section 352 of the ribbon case 64, and the wind-up gear 77 axially attached to the wind-up pivot 76.

The wind-up pivot 76 has a wind-up flange section 78 having contact with the right end surface of the wind-up core 63, and at the same time, having sliding contact with an inner right side surface of a wind-up case section 81 described later. The wind-up gear 77 is engaged with the wind-up output gear 229 of the transport driving device 22*b* described above in the closed state of the lid case 15 (see FIG. 5). Thus, the driving force from the transport driving device 22*b* (the DC motor 221) is transmitted to the wind-up core 63, and the wind-up core 63 rotates in the direction of winding the ink ribbon 61.

The feed-out gear 73 and the wind-up gear 77 also function as operation knobs for manually rotating the feed-out core 62 and the wind-up core 63, respectively. Thus, even in the case in which the feed-out core 62 or the wind-up core 63 rotates unintentionally to thereby loose the ink ribbon 61, by using the wind-up gear 77 as an operation knob it is possible to rewind the ink ribbon 61 thus loosed to the respective cores 62, 63.

The ribbon case 64 has the feed-out case section 80 for rotatably housing the feed-out core 62, the wind-up case section 81 for rotatably housing the wind-up core 63, and a pair of connection sections 82 for connecting the feed-out case section 80 and the wind-up case section 81 in both of the right and left ends thereof in the back and forth direction across the running path 66 of the ink ribbon 61. The ink ribbon 61 fed out from the ribbon body 60 is exposed from a ribbon delivery opening 83 formed on the feed-out case section 80, then pulled in a ribbon pull-in opening 87 provided to the wind-up case section 81 after passing through the running path 66, and then wound up by the wind-up core 63 (see FIGS. 2 and 4).

The feed-out case section 80 is provided with an upper feed-out case 85 rotatably disposed so that a front side is tipped up around a back end portion with respect to a lower feed-out case 84. Similarly, the wind-up case section 81 is provided with an upper wind-up case 89 rotatably disposed so that a backside is tipped up around a front end portion with respect to a lower wind-up case 88.

As shown in FIGS. 2 and 4, the sensor-facing section 841 facing the first photoelectric element 26 is formed on the lower surface of the lower feed-out case 84. The sensor-facing section 841 is formed to have a shape following the transport path (see the dashed line in FIG. 4) of the printing tape 32.

Therefore, the first photoelectric element 26 can be disposed in the vicinity of the ink ribbon 61 thus exposed, furthermore, in the vicinity of the thermal head 521. Further, it is possible to arrange the sensor-facing section 841 and the printing tape 32 on the transport path so as to be close to each other as much as possible. Thus, the outside light entering from, for example, a gap of the device case can be prevented from reaching the first photoelectric element 26 as much as possible. Further, by accurately detecting presence or absence of each of the detection target holes 323 and the printing tape 32, it is possible to perform the feeding of the label 322 and the tape end detection (that all of the printing tape 32 wound around the tape core 33 has been fed out) with good accuracy. In other words, by partially changing the shape of the ribbon case 64, false detection of the printing tape 32 (each of the detection target holes 323) can effectively be prevented.

Further, a black label sticker 842 is stuck to rough center portion of the sensor-facing section 841 in a horizontal direction. The label sticker 842 is stuck while folded to have an "L" shape so as to follow the lower feed-out case 84 (see FIG. 2). Thus, the light emitted from the first photoelectric element 26 and having reached the sensor-facing section 841 (the label sticker 842) can reliably be absorbed in this area. Further, it is possible to easily configure the sensor-facing section 841 without performing a coloring process such as coating on the ribbon case 64. It should be noted that it is also possible to eliminate the label sticker 842, and color the sensor-facing section 841 with a dark color such as black.

According to the above, the sensor-facing section 841 is formed at a position away from the ink ribbon 61 exposed from the ribbon cartridge 17 and the pair of ribbon path changing shafts 522, and the first photoelectric element 26 is arranged to be exposed to the lower surface of the printing tape 32 at the position opposed to the sensor-facing section 841, and detect the printing tape 32 on the transport path. Therefore, even in the case in which the ink ribbon 61 is colored similarly to the printing tape 32, there is no chance for the first photoelectric element 26 to mistakenly detect the ink ribbon 61 as the printing tape 32. Thus, the tape end detection can reliably be performed, and it is possible to obtain the trigger for performing an appropriate procedure such as stoppage of the printing process or notification of replacement of the tape cartridge 12. It should be noted that it is also possible for the second photoelectric element 28 to have substantially the same configuration as the first photoelectric element 26. In this case, the sensor-facing section 841 opposed to the second photoelectric element 28 is formed on the lower surface of the lower wind-up case 88.

As shown in FIGS. 11 and 12, the feed-out case section 80 and the wind-up case section 81 are each provided with bearing openings 86 formed on both of right and left end surfaces, respectively. Each of the bearing openings 86 on the right side is formed to have a circular shape so that the feed-out core 62 and the wind-up core 63 can rotatably be pivoted via the feed-out pivot 72 and the wind-up pivot 76. On the other hand, each of the bearing openings 86 on the left side is formed to have a roughly circular shape (D shape) with a straight side so as to disable a receiving member 91 of the cartridge-side brake mechanism 65 described later from rotating.

Here, in the ribbon cartridge 17, it is important to feed out the ink ribbon 61 while applying brake to the feed-out core 62 to thereby apply the back tension to the ink ribbon 61 in order to prevent the ink ribbon 61 thus fed out from loosening. Further, it is necessary to apply the brake to the wind-up core 63 in order to prevent the ink ribbon 61 from loosening when drawing away the ink ribbon 61 sticking to the platen roller 22*a* in the case of replacing the ribbon cartridge 17, or to prevent the ink ribbon 61 from loosening when handling (e.g., carrying) the ribbon cartridge 17.

As shown in FIGS. 11 through 13, the cartridge-side brake mechanism 65 has the feed-out brake mechanism 65*a* having the feed-out core 62 and the ink ribbon 61 wound around the feed-out core 62 as the braking target, and a wind-up brake mechanism 65*b* having the wind-up core 63 and the ink ribbon 61 wound around the wind-up core 63 as the braking target. It should be noted that although the details will be described later, the braking force of the feed-out brake mechanism 65*a* is set to be sufficiently stronger than the braking force caused by the device-side brake mechanism 13.

The feed-out brake mechanism 65*a* and the wind-up brake mechanism 65*b* are provided with a pair of rotating members 90 fixed to the shaft centers of the feed-out core 62 and the wind-up core 63 from the left side thereof, and integrally rotating with the respective cores 62, 63, a pair of receiving members 91 disposed coaxially with the respective rotating members 90, and fixed to the respective bearing openings 86 on the left side so as to be disabled from rotating, spring housing sections 92 having the same shape respectively formed on the surfaces where the respective receiving members 91 and the corresponding rotating members 90 are opposed to each other, and two types of cartridge-side plate springs 93 each having a ring-like shape, housed in the respective spring housing sections 92, and for applying the rotational braking force to the respective rotating members 90.

The cartridge-side plate springs 93 have two types of plate springs, namely a large-diameter plate spring 93*a* having a large diameter and a strong biasing force, and a small-diameter plate spring 93*b* having a smaller diameter and a weaker biasing force compared to the large-diameter plate spring 93*a*, and the large-diameter plate spring 93*a* is incorporated in the feed-out brake mechanism 65*a*, and the small-diameter plate spring 93*b* is incorporated in the wind-up brake mechanism 65*b*. It should be noted that the feed-out brake mechanism 65*a* and the wind-up brake mechanism 65*b* have roughly the same configuration except that the type of the spring incorporated therein is different.

Each of the rotating members 90 has a movable cylindrical section 94 fitted to the hollow shaft center of the corresponding one of the cores 62, 63, and a movable flange section 95 disposed on one end portion of the movable cylindrical section 94, and constituting the opposed surface of the spring housing section 92.

The movable cylindrical section 94 is disposed on the reverse side of the surface forming the opposed surface of the spring housing section 92 in the movable flange section 95 so as to project therefrom. On the surface of the movable flange section 95 to be the opposed surface, a moving-side ring-like projection 96 for positioning the large-diameter plate spring 93*a* with the outer peripheral portion is disposed so as to project therefrom. It should be noted that the movable cylindrical section 94, the movable flange section 95, and the moving-side ring-like projection 96 are arranged coaxially (concentrically). Further, the movable cylindrical section 94 and the movable flange section 95 are provided with a through hole 97 in which a fixed shaft section 98 of the receiving member 91 is inserted.

Each of the receiving members 91 has the fixed shaft section 98 for rotatably supporting the movable cylindrical section 94 in a retained manner, and a fixed flange section 99 disposed on one end portion of the fixed shaft section 98, and constituting the opposed surface of the spring housing section 92.

The fixed shaft section 98 is disposed on the surface forming the opposed surface of the spring housing section 92 in the fixed flange section 99 so as to project therefrom. The fixed shaft section 98 has the tip portion divided into four segments, and a hooking section 981 is formed on the outer surface of each of the segments. Thus, when inserting the fixed shaft section 98 into the through hole 97 of the rotating member 90, the hooking sections 981 are engaged with the tip surface of the movable cylindrical section 94, and the rotating member 90 and the receiving member 91 become in the retained state.

In the boundary portion between the surface of the fixed flange section 99 forming the opposed surface described above and the fixed shaft section 98, there is disposed a fixation-side ring-like projection 100 for positioning the small-diameter plate spring 93*b* with the inner peripheral portion of the spring so as to project therefrom. On the reverse side of the surface of the fixed flange section 99 forming the opposed surface, there is formed a D ring-like projection 101 so as to be engaged with the respective bearing openings 86 on the left side having the "D" shape. By the D ring-like projection 101 being engaged with the respective bearing openings 86 on the left side, each of the receiving members 91 is fixed in a retained manner.

The fixed flange section 99 is formed to have roughly the same outer diameter as that of the moving-side ring-like projection 96. In the state in which the fixed shaft section 98 is inserted in the through hole 97 to thereby connect the rotating member 90 and the receiving member 91 to each other, the fixed flange section 99 has contact with the moving-side ring-like projection 96. In other words, the area surrounded by the inner side surface of the moving-side ring-like projection 96, and the opposed surfaces of the movable flange section 95 and the fixed flange section 99 corresponds to the spring housing section 92.

The large-diameter plate spring 93*a* (the small-diameter plate spring 93*b*) housed in the spring housing section 92 biases the rotating member 90 in the axial direction (rightward) taking the receiving member 91 as a stopper. Therefore, the feed-out core 62 (the wind-up core 63) is pinched between the rotating member 90 and the inner right side surface of the feed-out case section 80 (the wind-up case section 81) due to the biasing force, and the braking force (the rotational load) is applied. Thus, the rotational braking force is applied to the feed-out core 62 and the wind-up core 63 in the ribbon cartridge 17, which is not mounted on the ribbon mounting section 51, and thus the slack of the ink ribbon 61 can be prevented.

Further, the moving-side ring-like projection 96 is formed to have a dimension (height) with which the compression of the cartridge-side plate spring 93 (the large-diameter plate spring 93*a* or the small-diameter plate spring 93*b*) falls within the elastic limit in the state in which the fixed flange section 99 has contact therewith. In other words, even if the force exceeding the elastic limit is applied to the plate spring in the assembly process, the moving-side ring-like projection 96 functions as the stopper, and thus the compression of the cartridge-side plate spring 93 can be prevented. Thus, the cartridge-side plate spring 93 can exert the normal biasing force in the spring housing section 92 after the assembly. Thus, it is possible to appropriately brake the rotation of the rotating member 90.

The large-diameter plate spring 93*a* is positioned on the movable flange section 95 side (the moving-side ring-like projection 96), and the small-diameter plate spring 93*b* is positioned on the fixed flange section 99 side (the fixation-side ring-like projection 100). Thus, the cartridge-side brake mechanism 65 can easily be assembled in the condition in which either one of the large-diameter plate spring 93*a* and the small-diameter plate spring 93*b* is accurately positioned without failure. Specifically, in the case of using the large-diameter plate spring 93*a*, the large-diameter plate spring 93*a* is mounted inside the moving-side ring-like projection 96 in the condition in which the moving-side ring-like projection 96 faces upward, and then the receiving member 91 is fitted therein from above. On the other hand, in the case of using the small-diameter plate spring 93*b*, the small-diameter plate spring 93*b* is inserted into the fixed shaft section 98, and then the small-diameter plate spring 93*b* is fitted into the fixation-side ring-like projection 100 in the condition in which the fixation-side ring-like projection 100 (the fixed shaft section 98) faces upward, and then the rotating member 90 is fitted therein from above. As described above, the cartridge-side brake mechanism 65 can easily be assembled with good accuracy.

As described above, by incorporating the large-diameter plate spring 93*a* with a strong biasing force in the feed-out brake mechanism 65*a*, while incorporating the small-diameter plate spring 93*b* in the wind-up brake mechanism 65*b*, it is possible to apply rotational braking forces different from each other respectively to the feed-out core 62 and the wind-up core 63. Thus, it is possible to apply tension (the back tension) to the ink ribbon 61 continuously. Further, since it is possible to selectively house either of the large-diameter plate spring 93*a* and the small-diameter plate spring 93*b* different in biasing force from each other in the spring housing sections 92 having the same shape, it is possible to easily change the braking force of the rotating member 90 (the feed-out core 62 and the wind-up core 63) without changing the design of the receiving member 91 and the rotating member 90. Further, since the large-diameter plate spring 93*a* and the small-diameter plate spring 93*b* have sliding contact with the opposed surfaces (the spring housing section 92) of the receiving member 91 and the rotating member 90 in the whole body thereof, it is possible to apply a stable braking force to the rotating member 90 and so on.

Mounting of Ribbon Cartridge

As shown in FIG. 2, when mounting the ribbon cartridge 17 on the ribbon mounting section 51, firstly, the feed-out case section 80 is mounted on the feed-out mounting section 511, then the wind-up case section 81 is mounted on the wind-up mounting section 512 while rotating the wind-up case section 81 using the feed-out case section 80 as a shaft. It is arranged that according to this operation, the ink ribbon 61 fed out on the running path 66 has contact with the thermal head 521 and the pair of ribbon path changing shafts 522.

On this occasion, it is possible that the wind-up case section 81 rotated to be mounted on the wind-up mounting section 512 has contact with the thermal head 521 and the ribbon path changing shafts 522 on the downstream side. In this case, by providing a large distance (the running path 66) between the feed-out case section 80 and the wind-up case section 81, the contact can be prevented. However, if the running path 66 is elongated, there arises a problem of growth in the ribbon cartridge 17 (the tape printer 1), or a problem that it becomes easy for the slack to occur in the ink ribbon 61.

Therefore, as described above, the ribbon mounting section 51 according to the present embodiment is arranged to make it possible to easily perform mounting of the feed-out case section 80 by placing the feed-out mounting section 511 nearer to the front side than the wind-up mounting section 512 in FIGS. 2 and 3. In other words, in the state in which the ribbon cartridge 17 is mounted on the ribbon mounting section 51, and the lid case 15 is closed, the feed-out mounting section 511 is positioned lower than the wind-up mounting section 512 (see FIG. 4). Further, according to this configuration, it is possible to prevent the wind-up case section 81 rotated from having contact with the thermal head 521 and the ribbon path changing shafts 522 on the downstream side without enlarging the running path 66.

Relationship Between Feed-Out Brake Mechanism and Device-Side Brake Mechanism

Here, in the state of closing the lid case 15, it results that the feed-out gear 73 of the feed-out brake transmission mechanism 71 provided to the ribbon cartridge 17 is engaged with the device-side gear 41 at the position nearer to the front side than the device-side gear 41 (see FIG. 3). If the rotational load of the device-side gear 41 is heavy, and the rotational load of the feed-out gear 73 is light, when mounting the ribbon cartridge 17 on the ribbon mounting section 51, and then closing the lid case 15, it results that the device-side gear 41 and the feed-out gear 73 are engaged with each other while the device-side gear 41 does not rotate, and the feed-out gear 73 rotates in the direction of feeding out the ink ribbon 61. On this occasion, the slack occurs in the ink ribbon 61 on the running path 66, and the normal transport operation of the ink ribbon 61 becomes unachievable. Therefore, the braking force of the feed-out brake mechanism 65*a* according to the present embodiment is set to be sufficiently stronger than the braking force caused by the device-side brake mechanism 13.

The rotational braking force is applied to the ribbon cartridge 17, which is not mounted, from the cartridge-side brake mechanism 65, and thus the slack of the ink ribbon 61 can be prevented. Further, in the ribbon cartridge 17, which is mounted, the back tension is applied to the ink ribbon 61, which has been fed out, from the device-side brake mechanism 13 besides the cartridge-side brake mechanism 65. Further, since the braking force of the device-side brake mechanism 13 is set to be weaker than the braking force of the feed-out brake mechanism 65*a*, if the device-side gear 41 has contact with the feed-out gear 73 in such a manner to urge the feed-out gear 73 (the feed-out core 62) to rotate when setting the ribbon cartridge 17 and then closing the lid case 15, there is no chance for the feed-out core 62 to rotate due to the braking force of the cartridge-side brake mechanism 65. Thus, it is possible to prevent the slack in the ink ribbon 61 mounted on the ribbon mounting section 51 and then fed out on the wind-up core 63 side to thereby perform the normal transport.

Further, since it is assumed that the cartridge-side brake mechanism 65 is disposable together with the ribbon cartridge 17, durability is not required. On the other hand, it is sufficient for the device-side brake mechanism 13 to exert weak braking force. Therefore, each of the brake mechanisms 13, 65 can be configured at low cost.

Further, the feed-out core 62 is pivoted in the condition in which the rotational braking forces are applied at both ends in the axial direction by the feed-out brake mechanism 65*a* and the device-side brake mechanism 13. Thus, since it is possible to apply the equal and stable braking force to the feed-out core 62, it is possible to apply the uniform back tension to the ink ribbon 61 having been fed out.

It should be noted that, similarly, the wind-up gear 77 of the wind-up driving transmission mechanism 75 is positioned nearer to the front side than the wind-up output gear 229 of the transport driving device 22*b*, and the wind-up gear 77 and the wind-up output gear 229 are engaged with each other, and the wind-up gear 77 rotates in the transport direction. However, in this case, the rotation is in the wind-up direction, and therefore, there is no chance of causing the slack in the ink ribbon 61.

Transport Path of Printing Tape

As shown in FIG. 4, the printing tape 32 is pinched between the thermal head 521 and the platen roller 22*a* via the ink ribbon 61, and the printing process is performed thereon by the thermal head 521 while being fed out from the tape body 30 by the rotation of the platen roller 22*a*. The printing process is performed while rotating the wind-up core 63 and the platen roller 22*a* in sync with each other by the DC motor 221. The printing tape 32 after the printing process is performed thereon is transported toward the sheet discharge opening 20, while the ink ribbon 61 is wound up by the wind-up core 63. It should be noted that the thermal head 521 and the platen roller 22*a* are formed to have a width roughly the same as the maximum width of the printing tape 32.

The tape cartridge 12 is mounted on the tape mounting section 21 positioned in the back portion of the device main body case 10, and the printing tape 32 is pivoted inside the tape cartridge 12 in the face-in roll configuration. The printing tape 32 is unwound from the lower side, and is fed out to the sheet discharge opening 20 with the labels 322 facing to the thermal head 521. In other words, since the printing tape 32 is fed out in an obliquely upper front direction, there is no chance that the printing tape 32 transported interferes with the feed-out mounting section 511 located at a lower position than the wind-up mounting section 512 in the closed state of the lid case 15 (see FIG. 4). Therefore, it is possible to make the printing tape 32 be appropriately exposed to the thermal head 521 without changing the transport path of the printing tape 32.

Further, since the change in the transport path is unnecessary, there is no need for unnecessarily bending the printing tape 32. Therefore, before printing there is no chance that the labels 322 are peeled from the release paper 321. Further, since there is no need for disposing the tape mounting section 21 unnecessarily distant from the thermal head 521 (the printing mechanism 52) and the ribbon cartridge 17 (the ribbon mounting section 51), the tape printer 1 can be downsized.

Mounting of Tape Cartridge and Feeding Control

The user opens the lid case 15, and mounts the tape cartridge 12 housing the tape body 30 having the printing tape 32 wound as a face-in roll on the tape mounting section 21. Then, the user pulls out the printing tape 32 from the cartridge case 31, then inserts the tip of the printing tape 32 into the sheet discharge opening 20, and then closes the lid case 15.

Before starting the printing, the tape printer 1 transports the printing tape 32 in the backward feed direction (feeding control) for preventing the label 322 having reached the sheet discharge opening 20 from being cut with no printing process performed thereon. Specifically, the tape printer 1 rotates the platen roller 22*a* in the reverse direction to thereby feed the printing tape 32 backward until the second photoelectric element 28 disposed at the sheet discharge opening 20 first detects the hole end shaped like a circular arc (the trailing side in the backward feed direction) of the detection target hole 323 opened in the printing tape 32 (the release paper 321). Subsequently, similarly to the normal printing process, the tape printer 1 rotates the platen roller 22*a* in the forward direction, and performs the printing operation on the label 322 exposed to the thermal head 521 based on the detection of the detection target hole 323 by the first photoelectric element 26 on the upstream side. Thus, it is possible to prevent the label 322 which is not used from being wasted.

It should be noted that the invention is not at all limited to the embodiment described above, but can be put into practice in various forms within the scope of the invention.

The entire disclosure of Japanese Patent Application No. 2011-145513, filed on Jun. 30, 2011, is expressly incorporated by reference herein.

The invention claimed is:

1. A processing device comprising:

a ribbon cartridge including an ink ribbon wound around a feed-out core and a wind-up core winding up the ink ribbon, a device main body to which the ribbon cartridge is detachably attached, a cartridge-side brake mechanism provided to the ribbon cartridge and applying a rotational braking force to the ribbon cartridge, a device-side brake mechanism provided to the device main body and applying a rotational braking force to the ribbon cartridge, and a brake transmission mechanism that transmits the rotational braking force by the device-side brake mechanism to the feed-out core when the ribbon cartridge is mounted on the device main body, the brake transmission mechanism comprising:

a cartridge-side pivot fitted to be fixed to the feed-out core, and rotatably supported by a sidewall section of the ribbon cartridge, a cartridge-side gear axially fixed to the cartridge-side pivot, a device-side gear releasably engaged with the cartridge-side gear, and a device-side pivot supported by a frame of the device main body, rotatably supporting the device-side gear, and connected to the device-side brake mechanism, wherein a rotational braking force by the cartridge-side brake mechanism is set stronger with respect to a rotational braking force by the device-side brake mechanism.

2. The processing device according to claim 1, wherein the cartridge-side gear also functions as an operation knob adapted to manually rotate the feed-out core.

3. The processing device according to claim 1, wherein the cartridge-side brake mechanism is connected to one end portion of the feed-out core to apply a rotational braking force to the feed-out core, and the device-side brake mechanism is connected to the other end portion of the feed-out core to apply a rotational braking force to the feed-out core.

4. The processing device according to claim 1, wherein the cartridge-side brake mechanism has a feed-out brake mechanism applying a rotational braking force to the feed-out core and a wind-up brake mechanism applying a rotational braking force to the wind-up core, and the rotational braking force applied to the feed-out core by the feed-out brake mechanism and the rotational braking force applied to the wind-up core by the wind-up brake mechanism are different from each other.

5. The processing device according to claim 1, wherein the cartridge-side brake mechanism has a feed-out brake mechanism applying a rotational braking force to the feed-out core and a wind-up brake mechanism applying a rotational braking force to the wind-up core, and the rotational braking force by the feed-out brake mechanism is set stronger with respect to a rotational braking force by the device-side brake mechanism.

* * * * *